US006854623B2

(12) United States Patent
Masuda

(10) Patent No.: US 6,854,623 B2
(45) Date of Patent: Feb. 15, 2005

(54) TUBE-TYPE CONTAINER

(76) Inventor: Masatoshi Masuda, 2, 9-banchi, Takada-Cho, Saiin, Ukyo-ku, Kyoto-city, Kyoto 615-0031 (JP)

( * ) Notice: Subject to any disclaimer, the term of this patent is extended or adjusted under 35 U.S.C. 154(b) by 250 days.

(21) Appl. No.: 10/165,802

(22) Filed: Jun. 7, 2002

(65) Prior Publication Data

US 2003/0047572 A1 Mar. 13, 2003

(30) Foreign Application Priority Data

Sep. 10, 2001 (JP) ..... 2001-273137

(51) Int. Cl.[7] ..... B65D 5/72
(52) U.S. Cl. ..... 222/212; 222/494; 222/496
(58) Field of Search ..... 222/212, 491, 222/494, 496, 497

(56) References Cited

U.S. PATENT DOCUMENTS

| | | | |
|---|---|---|---|
| 3,165,242 | A | 1/1965 | Jackson |
| 3,246,807 | A | 4/1966 | Micallef |
| 3,344,963 | A | 10/1967 | Wynes et al. |
| 3,456,650 | A | 7/1969 | Schwartzman |
| 3,705,668 | A | 12/1972 | Schwartzman |
| 3,945,540 | A | 3/1976 | Mantchev |
| 5,152,434 | A | 10/1992 | Birmelin |
| 5,524,795 | A | 6/1996 | Lee |
| 5,819,990 | A | 10/1998 | Cimentepe et al. |
| 2002/0005415 | A1 | 1/2002 | De Laforcade |

FOREIGN PATENT DOCUMENTS

| | | | |
|---|---|---|---|
| DE | 43 29 808 | A | 3/1995 |
| DE | 297 06 456 | U | 8/1998 |
| EP | 0 537 822 | A1 | 4/1993 |
| FR | 1 354 498 | A | 3/1964 |
| FR | 1 433 142 | A | 3/1966 |
| JP | 59-26748 | | 2/1984 |
| JP | 07-112749 | | 5/1995 |
| JP | 08-026311 | | 1/1996 |
| JP | 08-034452 | | 2/1996 |
| JP | 10-157751 | | 6/1998 |
| KR | 20-0241101 | | 7/2001 |
| TW | 223350 | | 7/1982 |
| TW | 288432 | | 10/1983 |
| TW | 255372 | | 1/1984 |
| WO | WO 89/01104 | | 2/1989 |
| WO | WO 95/10965 | | 4/1995 |
| WO | WO 02/22458 | A1 | 3/2002 |

*Primary Examiner*—Kenneth Bomberg
(74) *Attorney, Agent, or Firm*—Knobbe, Martens, Olson & Bear LLP

(57) ABSTRACT

A tube-type container includes a container main body, a lid material to be attached in the top of the container main body, a valve body 20 comprising an opening/closing mechanism and a tube-shaped material 30. On the top periphery of the tube-shaped material 30, an engaging groove 32 that can be engaged with the container main body is formed. On the inner circumference of the tube-shaped material 30, the first tapered portion 31 is formed, and in the under surface 34 in the tube-shaped material 30, an opening portion 33 is formed. In the valve body 20, the second tapered portion 21 is formed. Additionally, in the lower end portion of the valve body 20, a regulating portion 22 is formed.

14 Claims, 44 Drawing Sheets

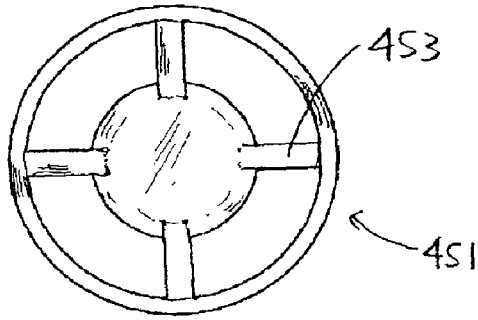
Fig.41(a)
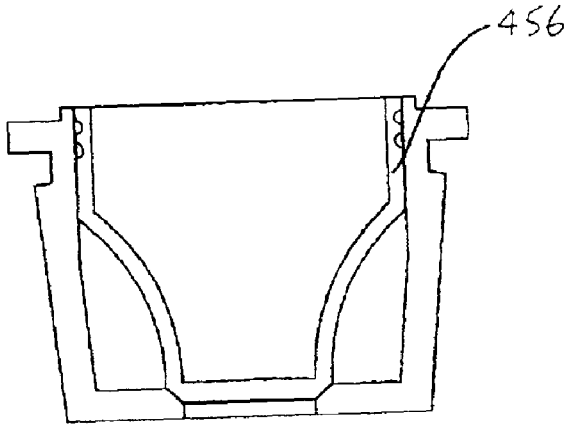
Fig.41(b)
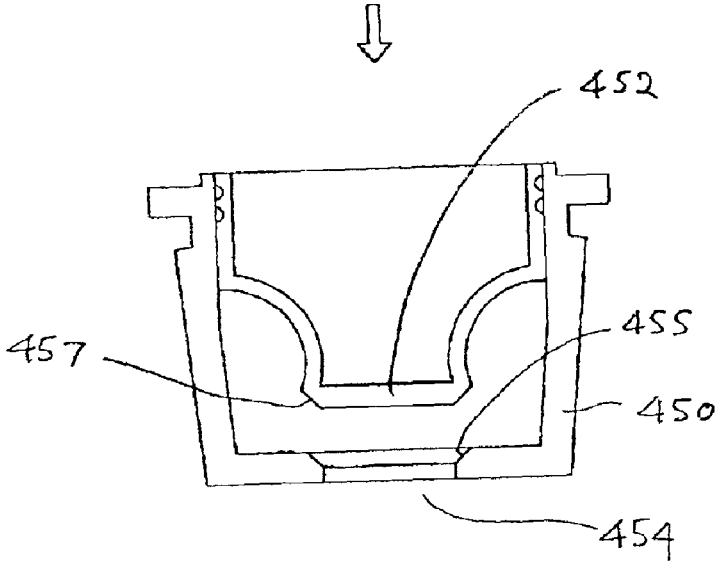

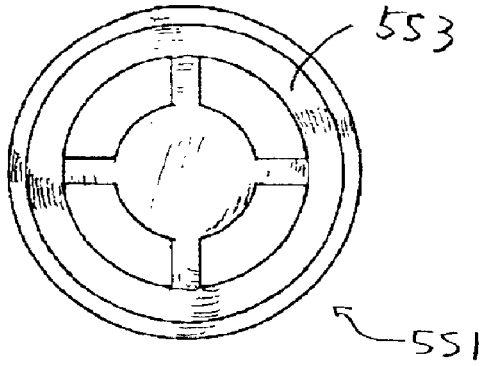
Fig. 42(a)
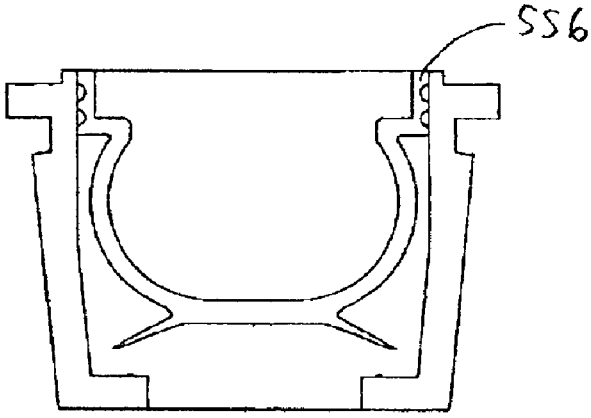
Fig. 42(b)
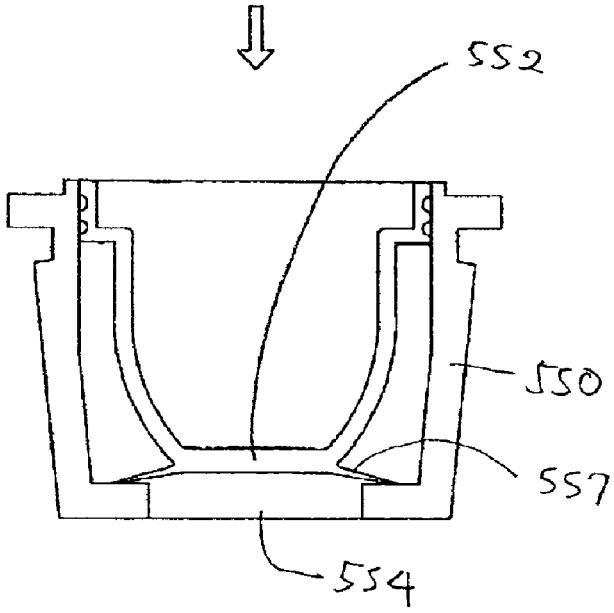

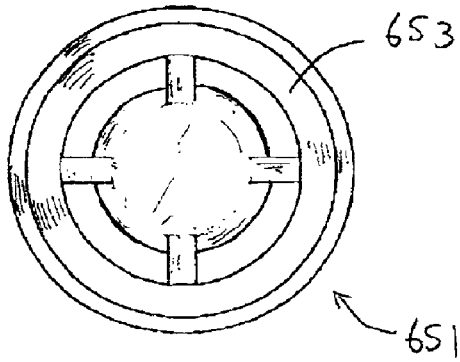
Fig.43(a)
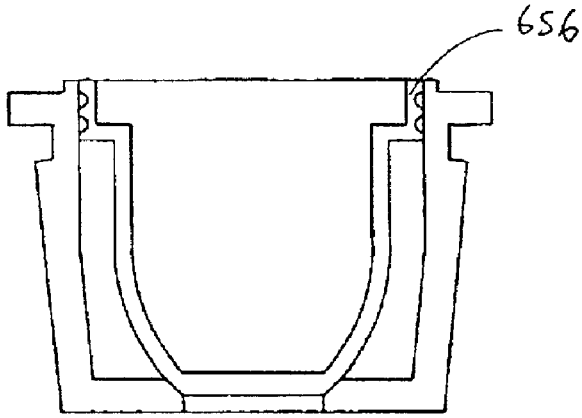
Fig.43(b)
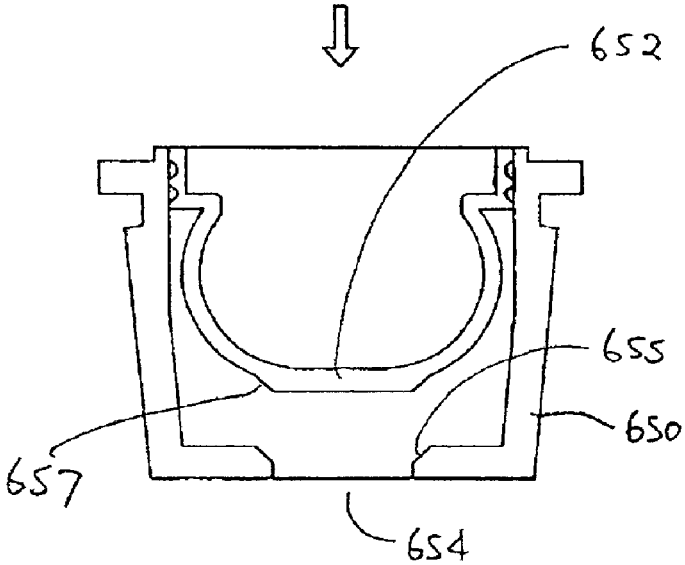

TUBE-TYPE CONTAINER

BACKGROUND OF THE INVENTION

1. Field of the Invention

The present invention relates to a tube-type container that comprises synthetic resin having elasticity restoring strength and that stores a fluid inside it.

2. Description of the Related Art

Regarding this kind of tube-shaped containers, replacing conventional tubes comprising a metal or aluminum foil laminated material, tubes having composition of solely synthetic resin or a synthetic resin and aluminum laminated material (in this specification, these are generically named "made of synthetic resins") have been used in recent years.

Because such synthetic resin tube has elasticity-restoring strength, if applying a pressure to the tube and then releasing the pressure applied after discharging a fluid stored inside it, there is a problem that the elasticity-restoring strength of the tube causes the air to flow backward to the fluid-storing portion from the opening portion for discharging the fluid. As a result, the quality of the fluid stored deteriorates.

For this reason, a tube-type container, which has a flat-plate-shaped valve body attached in the opening portion for discharging a fluid so that the opening portion is blocked off by this valve body when the elasticity of the tube is restored, was proposed (e.g., Japanese Patent Laid-open No.1995-112749, Japanese Patent Laid-open No.1998-157751, Utility Model Patent Laid-open No.1984-26748).

SUMMARY OF THE INVENTION

In the tube-type container with such a conventional flat-plate-shaped valve body attached, if the tube carries out elasticity-restoring strength movements slowly, the valve body does not block off the opening portion of the tube-type container and there are some cases where the air flows backward to the fluid-storing portion.

Additionally, in a tube-type container with the conventional flat-plate-shaped valve body attached, there are problems that the cost of production is high because high process precision is required, and that durability is low.

The present invention was achieved to solve the above-mentioned problems. The present invention aims to provide a tube-type container by which back-flow of air can be reliably prevented although the construction is simple, and which is excellent in durability.

In an embodiment, the present invention is characterized in that a tube-shaped container comprises: a tube-type container main body that comprises synthetic resin having elasticity-restoring strength and that possesses a fluid-storing portion for storing a fluid inside it and an opening portion for discharging the fluid, which is formed in one end of the fluid-storing portion; a tube-shaped material possessing a fluid flow path, which has a nearly tube-like shape that can be attached inside the opening portion of the container main body and on the inner circumference of which the first tapered portion with its internal diameter gradually reducing toward the side of the fluid-storing portion is formed; the second tapered portion that can block off the fluid flow path in the tube-shaped material by contacting the first tapered portion in the tube-shaped material; and a valve body that possesses a regulating portion regulating a distance by contacting the tube-shaped material so that the second tapered portion does not move away beyond the designated distance.

The present invention is not limited to the above specific embodiment but includes various backflow preventive tube-type containers which comprise: (i) a tube-type container main body for storing a fluid therein, said main body having a mouth portion for discharging the fluid, said main body being squeezable and having an elasticity-restoring function; (ii) a cylinder-shaped material fitted in the mouth portion, said cylinder-shaped material having at a bottom an opening through which the fluid passes; (iii) a valve body comprising a fitting portion configured to be liquid-tightly fitted in the opening, said valve body being movable in said cylinder-shaped material along its axis; and (iv) a support for limiting movement of the valve body away from the opening, wherein the cylinder-shaped material, the valve body, and the support are co-axially arranged, (v) wherein when the main body is pressed by external force, the fluid pushes the valve body and is discharged through the opening, and when the external force is released, the pressure inside the main body becomes lower than the pressure outside the main body due to elasticity of the main body, thereby retracting the fluid at the opening and closing the valve body. The present invention can be applied to various embodiments, which may include but is not limited to the following.

In embodiments, the valve body and the support may be integrally formed as a single piece. The fitting portion may be convex. Further, the cylinder-shaped material may have a central opening where the valve body is provided, and the opening through which the liquid passes may be formed around the central opening separately therefrom. Additionally, the support may be fixed to the cylinder-shaped material and be attached to a top of the valve body inside the cylinder-shaped material. The support may be elastic, and when no external force is applied, no force may be exerted on the valve body. The valve body may be elastic and collapsed to open the opening when external force is applied. In other embodiments, the support may be integrated with the valve body and provided at a bottom of the valve body outside the cylinder-shaped material.

Further, the support can be a circular flange provided at a tip of the fitting portion which flange has a diameter larger than the opening's diameter. Alternatively, the support may be a perforated disc connected to the fitting portion, which disc is elastic and has a periphery attached to an inner wall of the cylinder-shaped material. The disc may be directly attached to the fitting portion. The disc may have a central projection attached to the fitting portion.

In other embodiments, the support may comprise (i) a perforated elastic cylindrical member attached under the cylinder-shaped material and having a central opening, and (ii) a connecting member having a head having a larger diameter than a diameter of the central opening, wherein an end of said connecting member opposite to the head is inserted though the central opening and attached to a tip of the fitting portion. Further, the support may be bellows having two ends, one end being attached to an inner wall of the cylinder the shaped material, the other end being attached to a base of the fitting portion.

In other aspects of the present invention, the container may further comprises a lid portion comprising a lid body and a lid base, wherein the lid base is attached to the mouth portion of the main body and fixes the cylinder-shaped material interposed between the lid base and the mouth portion, which lid base has a throughhole through which the fluid is discharged, which lid body closes the throughhole by press fitting to the lid base. In the above, the mouth portion and the lid base may have screw threads for fitting together, wherein the cylinder-shaped material is fixed therebetween.

In an embodiment, the main body is made of a plastic laminate material. The fluid to be stored may be a viscous liquid. The main body has an "elasticity-restoring function" which includes "self-restoring" and "partially elasticity-restoring" to any degree, but excludes complete plastic deformation. That is, after a certain amount of the liquid is discharged from the main body through the mouth, the pressure of the liquid stored in the main body can be constantly lower than the pressure of the liquid filling the cylinder-shaped material. Thus, it is not necessary to constantly exert downward force on the valve body to forcefully close the opening. By using the elasticity-restoring function, the structure of the valve body can be simplified. Any suitable material which satisfies the above can be used for a tube-type main body.

For purposes of summarizing the invention and the advantages achieved over the prior art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

FIG. 41(*a*) is a top view of the valve body 451, and FIG. 41(*b*) is a cross sectional view showing an outline of the valve body 451 and the tube-shaped material 450.

FIG. 42(*a*) is a top view of the valve portion 551, and FIG. 42(*b*) is a cross sectional view showing an outline of the valve portion 551 and the tube-shaped material 550.

FIG. 43(*a*) is a top view of the valve portion 651, and FIG. 43(*b*) is a cross sectional view showing an outline of the valve portion 651 and the tube-shaped material 650.

In the figures, the symbols denote the following, for example: 10 Lid material; 11 lid base; 12 Lid body; 13 Opening portion; 14 Stoppage portion; 15 Female screw portion; 20 Valve body; 21 Second tapered portion; 22 Regulating portion; 30 Tube-shaped material; 31 First tapered portion; 32 Engaging groove; 33 Opening portion; 34 Under surface; 40 Container main body, 41 Opening portion; 42 Fluid storing portion; 43 Flange portion; 44 Male screw portion.

DETAILED DESCRIPTION OF THE PREFERRED EMBODIMENT

Figure 1:
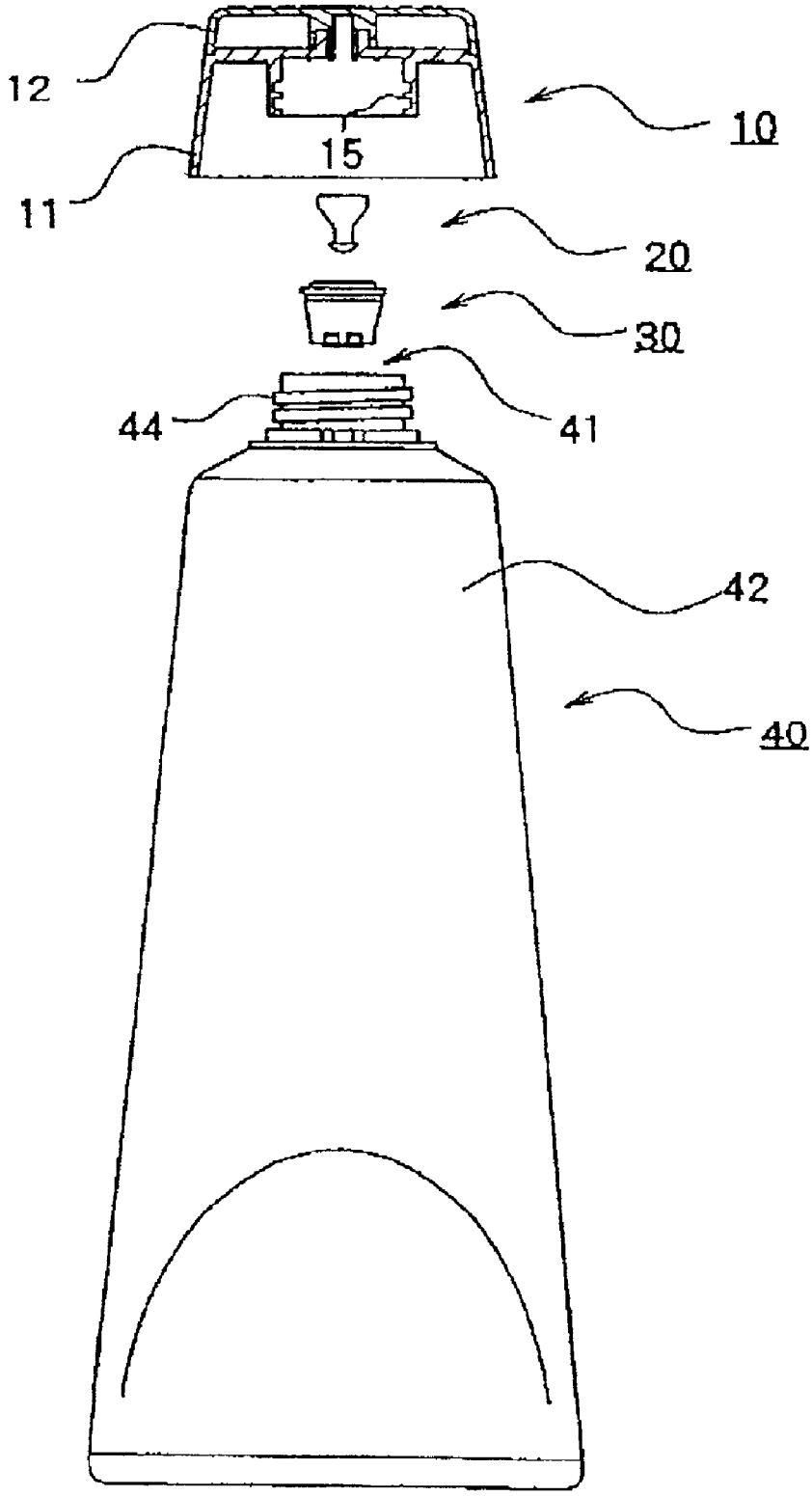
FIG. 1 is an exploded schematic diagram showing the tube-type container according to a first embodiment of the present invention.
Figure 2:
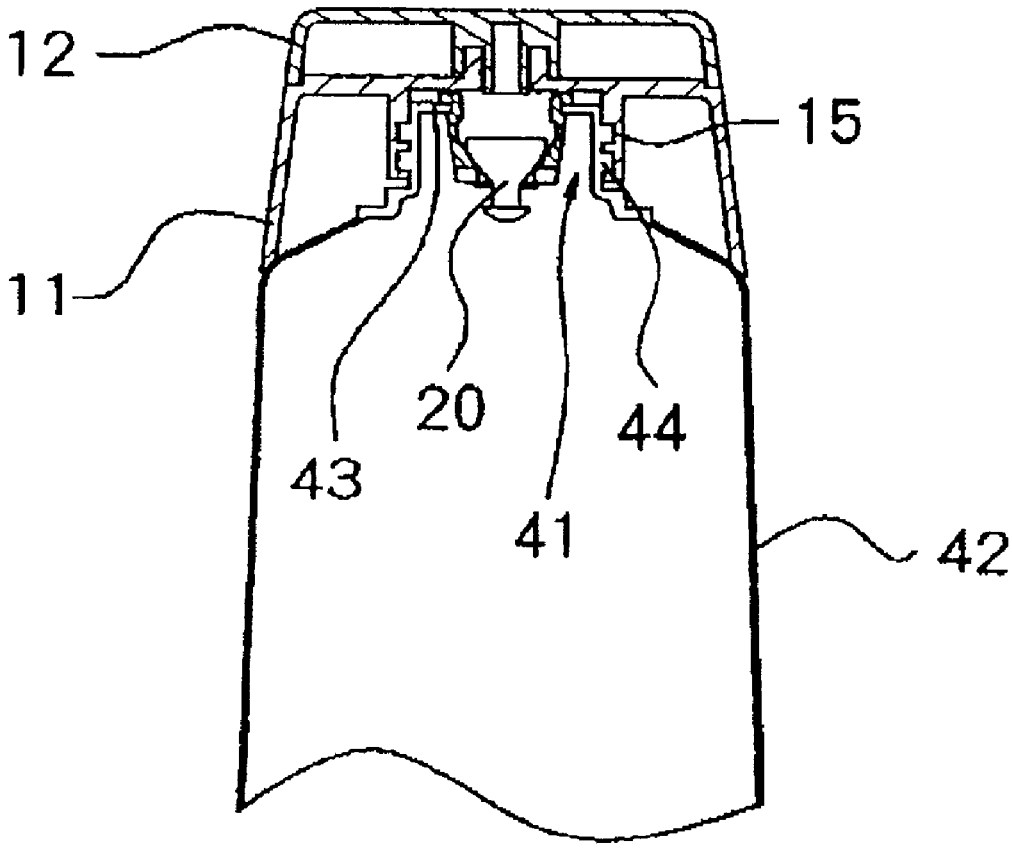
FIG. 2 is an enlarged view showing the tube-type container according to the first embodiment of the present invention.
Figure 3:
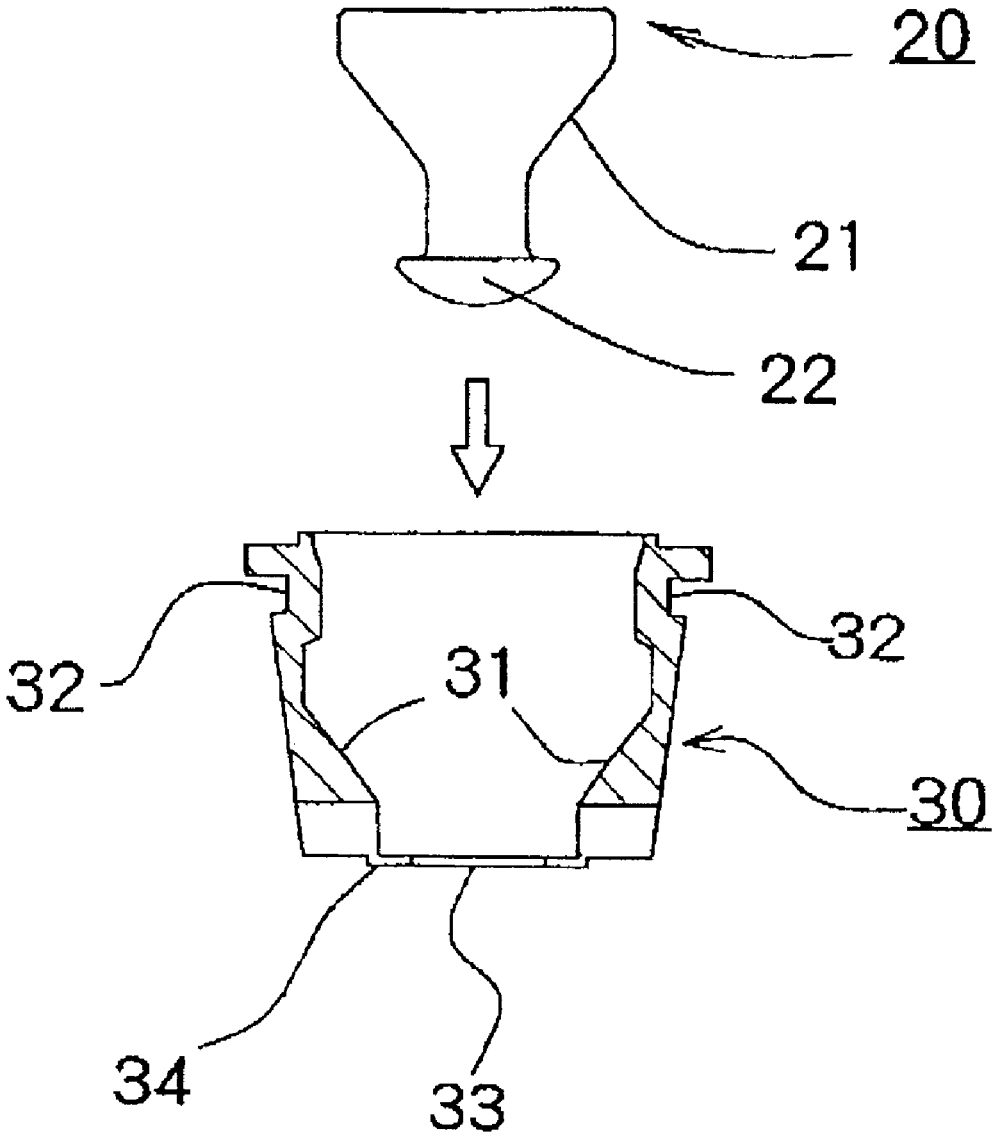
FIG. 3 is an enlarged view showing an outline of the valve body 20 and the tube-shaped material 30.
Figure 4:
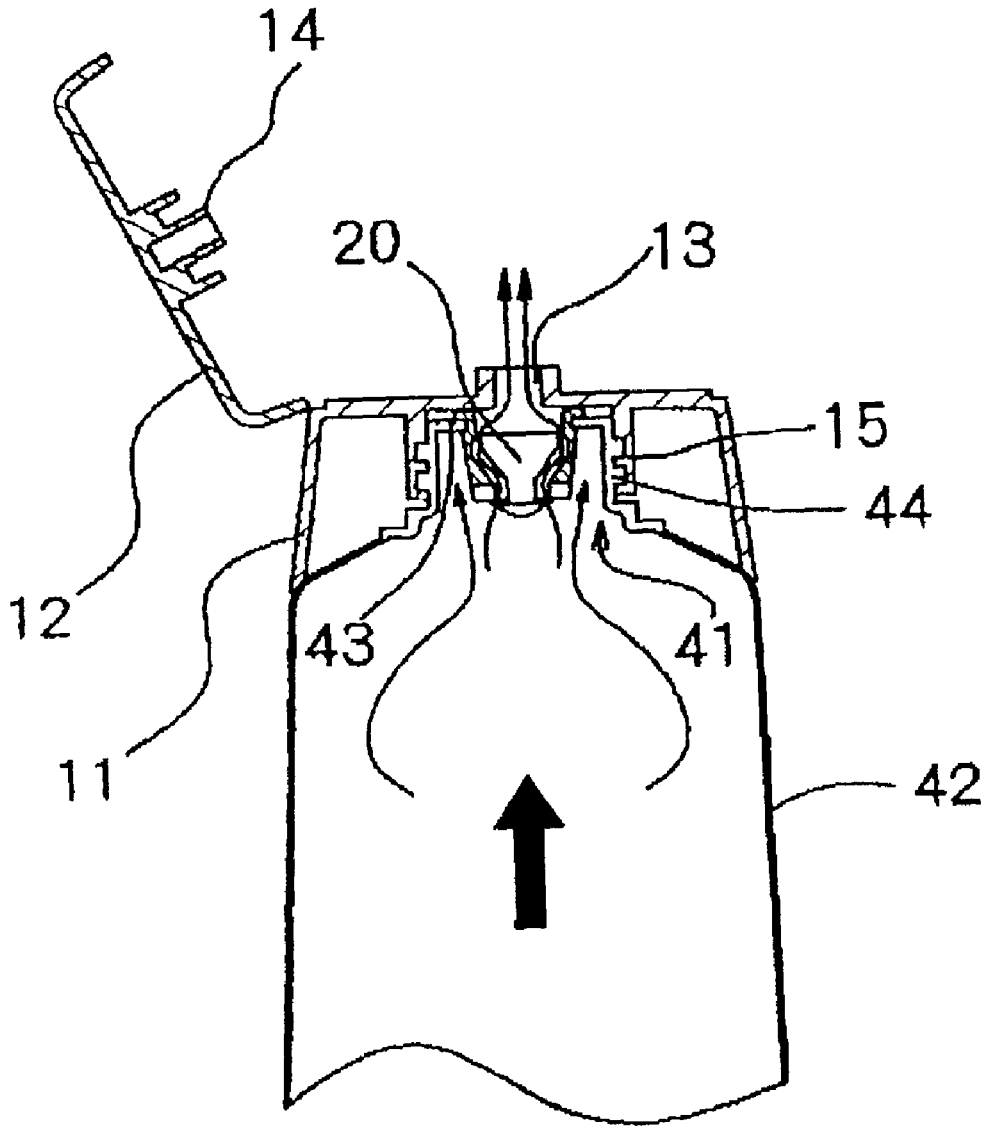
FIG. 4 is a schematic diagram showing the discharging movements of the fluid by the tube-type container according to the first embodiment of the present invention.
Figure 5:
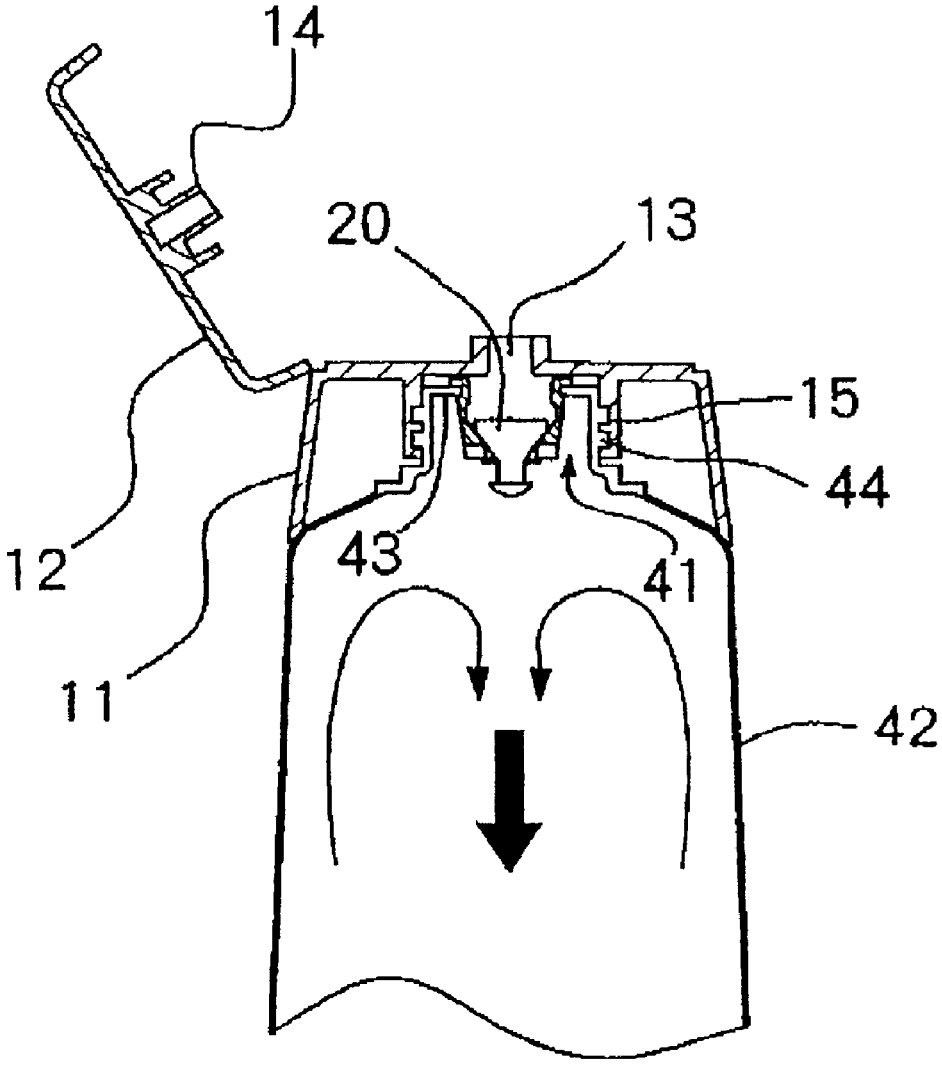
FIG. 5 is a schematic diagram showing the state of finishing discharging the fluid by the tube-type container according to the first embodiment of the present invention.
Figure 6:
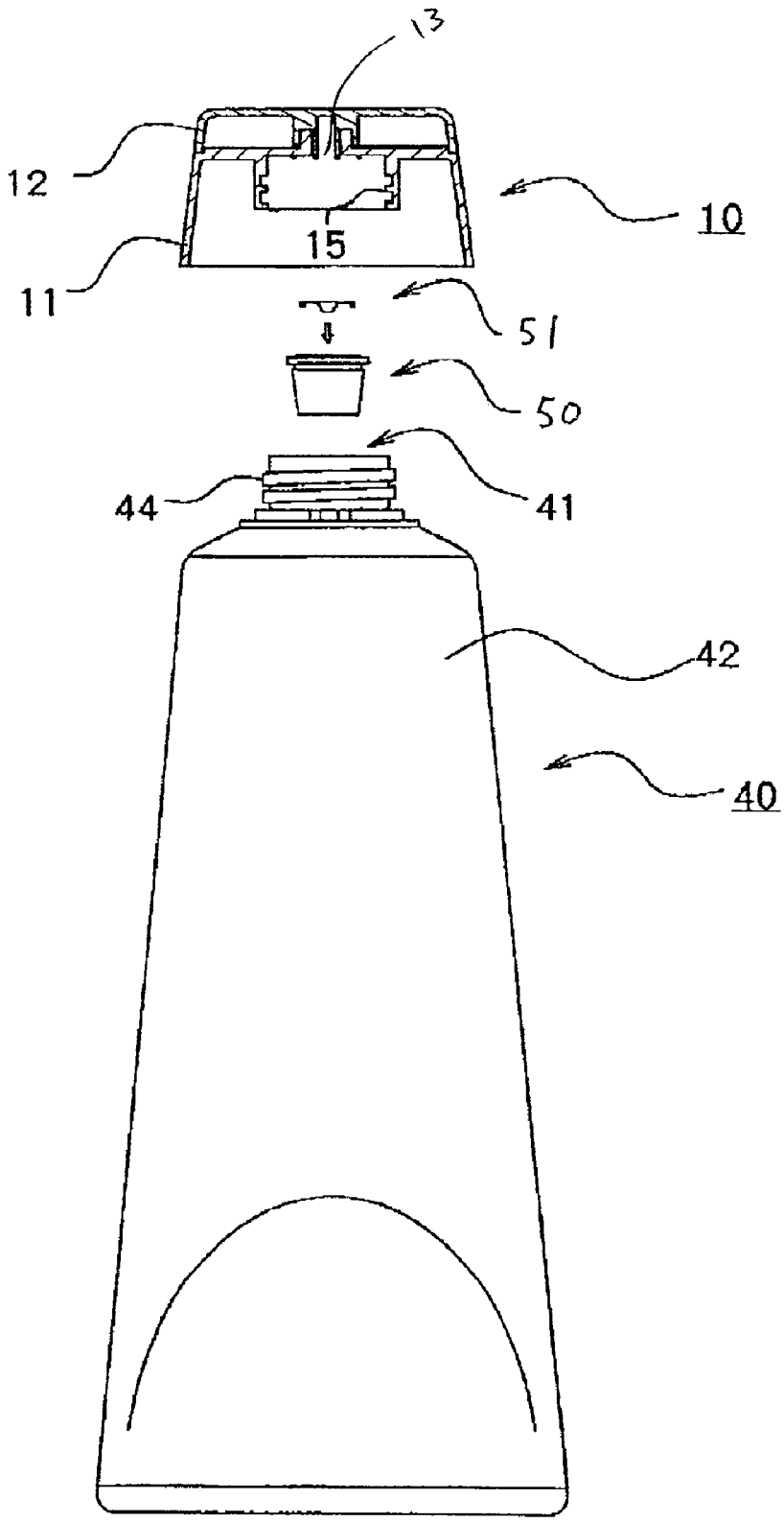
FIG. 6 is an exploded schematic diagram showing the tube-type container according to a second embodiment of the present invention.

The best mode for carrying out an embodiment of the present invention is described below based on figures. The present invention is not limited to this embodiment and includes various modifications of the embodiment. FIG. 1 shows an exploded view of the tube-type container according to the present invention. FIG. 2 shows an enlarged view of a material part of the tube-type container according to the present invention. FIG. 3 shows an enlarged schematic view of a valve body 20 and a tube-shaped material 30 comprising an opening/closing mechanism. FIG. 4 and FIG. 5 show views of discharging and finishing discharging the fluid by the tube-type container, respectively, according to the present invention.

This tube-type container is used as containers for hair gel, cleansing gel, etc., which are generically named "gel" and used in the cosmetics field, or for creams such as nourishing creams, massage creams, etc. Additionally, this tube-type container can also be used as containers for general medicines and solvents or food, etc.

In this specification, including regular liquids, high-viscosity liquids, semifluids, gels obtained by solidifying sol, and creams, all are referred to as fluids.

This tube-type container possesses a container main body 40, a lid material 10 to be attached on the top of the container main body 40, a valve body 20 comprising an opening/closing mechanism, and a tube-shaped material 30.

The container main body 40 possesses a fluid-storing portion 42 for storing a fluid inside it, an opening portion 41 for discharging the fluid, which is formed at one end of the fluid storing portion 42, a flange portion 43 formed near the upper end of the opening portion 41, and a male screw portion 44 formed outside the opening portion 41.

The container main body 40 has a composition of solely synthetic resin or a synthetic resin and aluminum laminated material, and has elasticity-restoring strength trying to reconstitute to its original shape when a pressure applied is released.

The lid material 10 possesses a lid base 11 in the center of which the opening portion 13 is formed, the female screw portion 15 formed in the lid base 11 and a lid body 12 in the center of the under surface of which a stoppage portion 14 is formed. As shown in FIG. 4 and FIG. 5, the lid body 12 is constructed so as to hinge with the lid base 11. Consequently, the lid body 12 moves between a position in which the stoppage portion 14 shown in FIG. 2 closes the opening portion 13 formed in the lid base 11 and a position shown in FIG. 4 and FIG. 5 in which the stoppage portion opens the opening portion 13 formed in the lid base 11. The female screw portion 15 in the lid base 11 is constructed so as to fit in with the male screw portion 44 in the container main body 40.

The tube-shaped material 30, as shown in FIG. 3, has a nearly tube-like shape that can be attached inside the opening portion 41 in the container main body 40. In other words, it is constructed that, on the top periphery of the tube-shaped material 30, an engaging groove 32 that can be engaged with the flange portion 43 in the container main body 40 is formed, and the tube-shaped material 30 is fixed inside the opening portion 41 in the container main body 40 through this engaging groove 32.

In the inner circumference of the tube-shaped material 30, as shown in FIG. 2 and FIG. 3, the first tapered portion 31 whose internal diameter gradually becomes smaller toward the side of the fluid-storing portion 42 in the container main body 40 is formed, and the opening portion 33 is formed in the under surface 34 of the tube-shaped material 30. Consequently, inside the tube-shaped material 30, a fluid flow path is formed.

In the valve body 20, as shown in FIG. 2 and FIG. 3, the second tapered portion 21 whose internal diameter gradually becomes smaller toward the side of the fluid storing portion 42 in the container main body 40 is formed. Additionally, in the lower end portion of the valve body 20, a regulating portion 22 is formed. The external diameter of this regulating portion is slightly larger than the internal diameter of the opening portion 33 formed in the under surface 34 of the tube-shaped material 30. When this valve body 20 is attached inside the tube-shaped material 30, it is attached so that the regulating portion 22 can pass through the opening portion 33 by a certain amount of pressure.

The second tapered portion 21 of the valve body 20 has a construction so that it can block off the fluid flow path in the tube-shaped material 30 by contacting the first tapered portion 31 in the tube-shaped material 30. Additionally, in a position where the valve body 20 is attached inside the tube-shaped material 30, with the regulating portion 22 of the valve body 20 being contacted with the under surface 34 of the tube-shaped material 30, a distance of the valve body is regulated so that the second tapered portion in the valve body 20 does not move away beyond a designated distance from the first tapered portion 31 in the tube-shaped material 30.

In the tube-type container having a construction described above, when a fluid is discharged from inside the container, a pressure should be applied to the fluid stored inside the fluid-storing portion 42 by pressing the fluid-storing portion 42 in the container main body 40. In this position, as shown in FIG. 4, being pushed by the fluid, the valve body 20 moves up to a position where its regulating portion 22 contacts the under surface 34 of the tube-shaped material 30. In this position, the fluid stored inside the fluid-storing portion 42 passes through an area between the first tapered portion 31 of the tube-shaped material 30 and the second tapered portion 21 of the valve body 20 and then is discharged outside through the opening portion 13 in the lid material 10.

When the pressure applied to the fluid-storing portion 42 is released after a necessary amount of the fluid is discharged, a pressure applied to the fluid stored inside the fluid-storing portion 42 is reduced by the elasticity-restoring strength of the container main body 40, and the air tries to flow backward toward the fluid-storing portion 42 from the opening portion 41 for discharging the fluid.

However, in this tube-type container, when the pressure applied to the fluid stored inside the fluid-storing portion 42 is reduced by the action of the regulating portion 22 due to the close arrangement of the second tapered portion 21 in the valve body 20 and the first tapered portion in the tube-shaped material 30, the second tapered portion 21 in the valve body 20 and the first tapered portion 31 in the tube-shaped material 30 impinge on and contact each other instantaneously, and the flow path for the fluid in the tube-shaped material is closed as shown in FIG. 5. Consequently, back flow of air can be effectively prevented.

In the embodiment described above, the lid material 10 possessing the lid base 11, in the center of which the opening portion 13 is formed, and the lid body 12, in the center of the under surface of which the stoppage portion 14 is formed, are used. A lid material having a construction, in which the lid base 11 and the lid body 12 are integrated and the entire integrated portion can be detached from the container main body 40 when discharging a fluid, can be used.

In the above, according to other embodiments of the present invention, the tube-shaped material 30 need not be a separate piece from the container main body 40, but can be integrated with the container main body 40 without using the lid base 11. Further, the regulating portion 22 need not be formed at the lower end of the second tapered portion 21, but can be formed in the tube-shaped material 30. For example, by forming a flange protruding inward from the inner wall of the tube-shaped material 30, the upper end of the second tapered portion 21 can contact the flange so that upper movement of the second tapered portion 21 can be limited. The lid body 12 need not be an extension of the lid body 11, but can be a separate piece to close the opening of the tube-shaped material 30.

According to the tube-type container of an embodiment of the present invention, because of its construction in that by making the first tapered portion in the tube-shaped material contact the second tapered portion in the valve body, the flow path of a fluid is blocked off. Because of this construction, high processing precision is not required for blocking off the flow path as compared with cases where a flat-plate-shaped or bulb-shaped valve body is used, and back flow of air can be prevented reliably.

Additionally, because of its construction in that flowing of the fluid is prohibited by making the first tapered portion in the tube-shaped material contact the second tapered portion in the valve body, and in that flowing of the fluid is released by making the first tapered portion in the tube-shaped material separate from the second tapered portion in the valve body, high endurance can be obtained.

Furthermore, a distance between the second tapered portion in the valve body and the first tapered portion in the tube-shaped material is regulated by the action of the regulating portion so that the second tapered portion does not move away from the first tapered portion beyond a designated distance. Here, because the first tapered portion and the second tapered portion are mutually planate materials and these planate materials are closely positioned by the action of the regulating portion, the first tapered portion in the tube-shaped material and the second tapered portion in the valve body contact each other instantaneously when a pressure applied to the fluid inside the fluid storing portion 42 is reduced. Due to this, as compared with cases where a flat-plate-shaped or bulb-shaped valve body is used, back flow of air into the fluid-storing portion can be effectively prevented.

The present invention should not be limited to the above specific embodiment but includes various other embodiments. That is, the present invention provides a backflow preventive tube-type container comprising: (a) a tube-type container main body for storing a fluid therein, said main body having a mouth portion for discharging the fluid, said main body being elastic when the fluid is stored therein; (b) a cylinder-shaped material fitted in the mouth portion, said cylinder-shaped material having at a bottom an opening through which the fluid passes; (c) a valve body comprising a convex portion configured to be liquid-tightly fitted in the opening, said valve body being movable in said cylinder-shaped material only in its axial direction; and (d) a support for limiting movement of the valve body away from the opening, wherein when the main body is pressed by external force, the fluid pushes the valve body and is discharged through the opening, and when the external force is released, the pressure inside the main body becomes lower than the pressure outside the main body due to elasticity of the main body, thereby retracting the fluid at the opening and closing the valve body.

In the above, as explained with reference to FIGS. 1–5, the cylinder-shaped material can have a first tapered portion at the bottom, and the convex portion has a second tapered portion, said first and second tapered portions configured to be fitted together liquid-tightly. Further, the support can be a circular flange provided at a tip of the convex portion, said flange having a diameter larger than the opening's diameter. In these figures, the regulating portion 22 corresponds to the support. Other embodiments includes those shown in FIG. 6 through FIG. 25.

Figure 7:
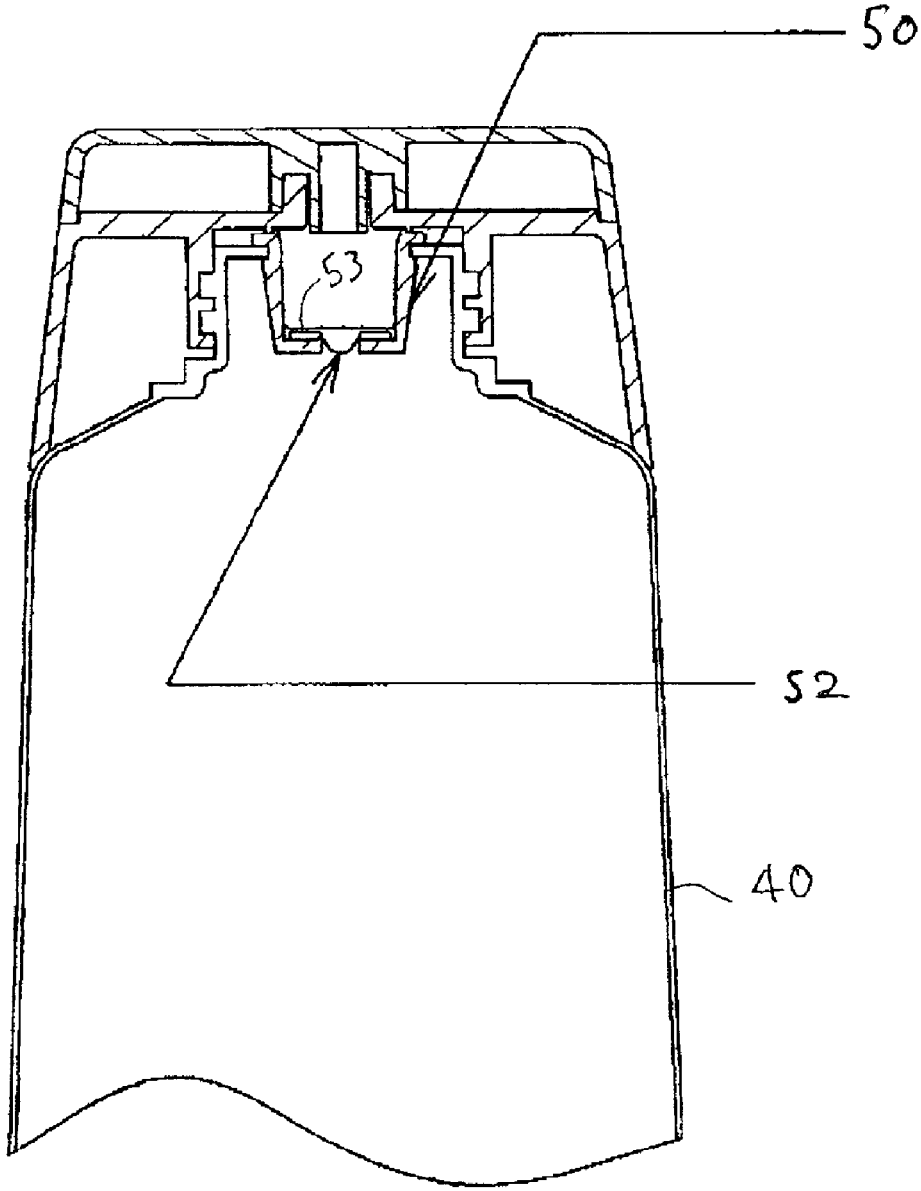
FIG. 7 is an enlarged view showing the tube-type container according to the second embodiment of the present invention.
Figure 8:
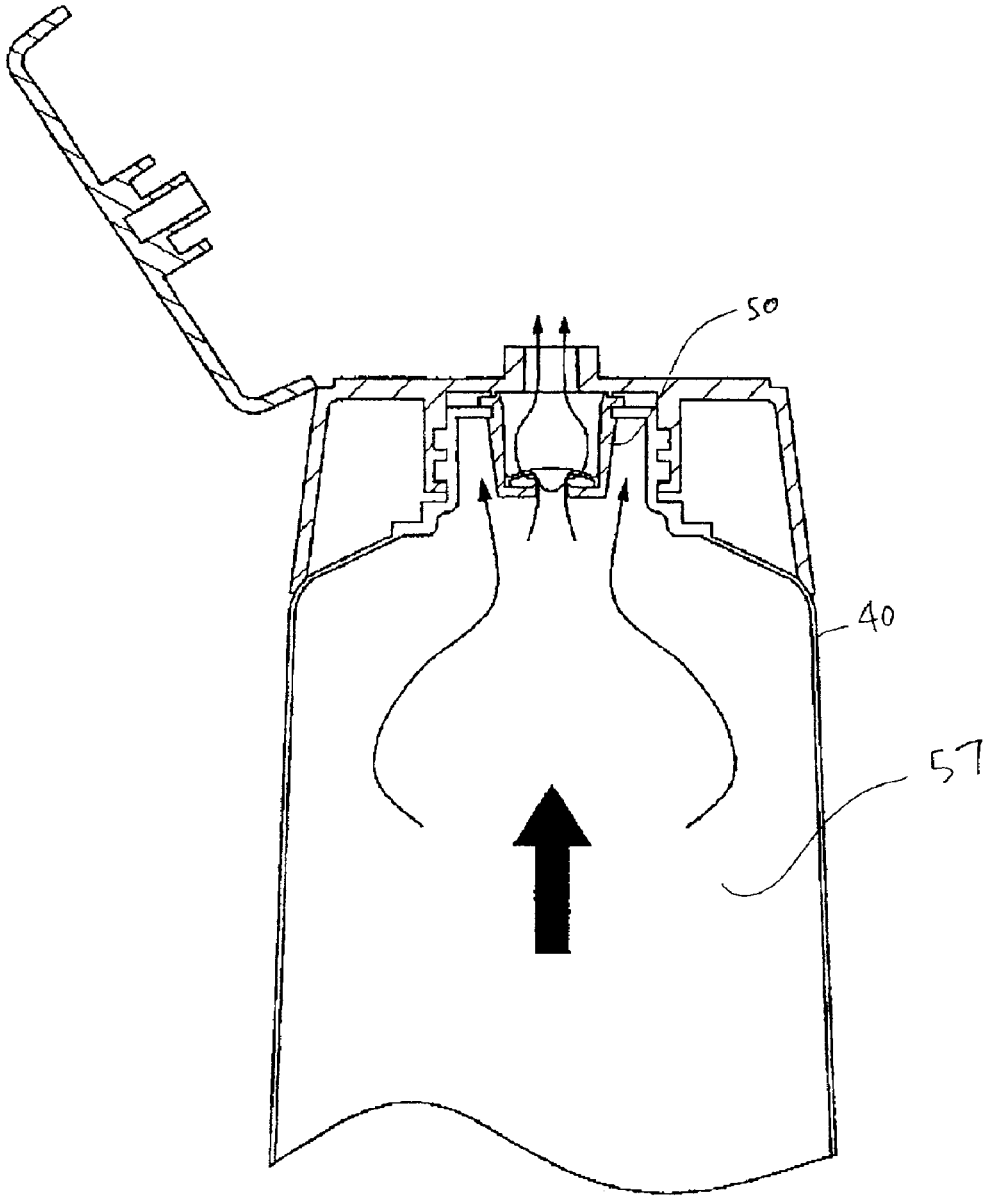
FIG. 8 is a schematic diagram showing the discharging movements of the fluid by the tube-type container according to the second embodiment of the present invention.
Figure 9:
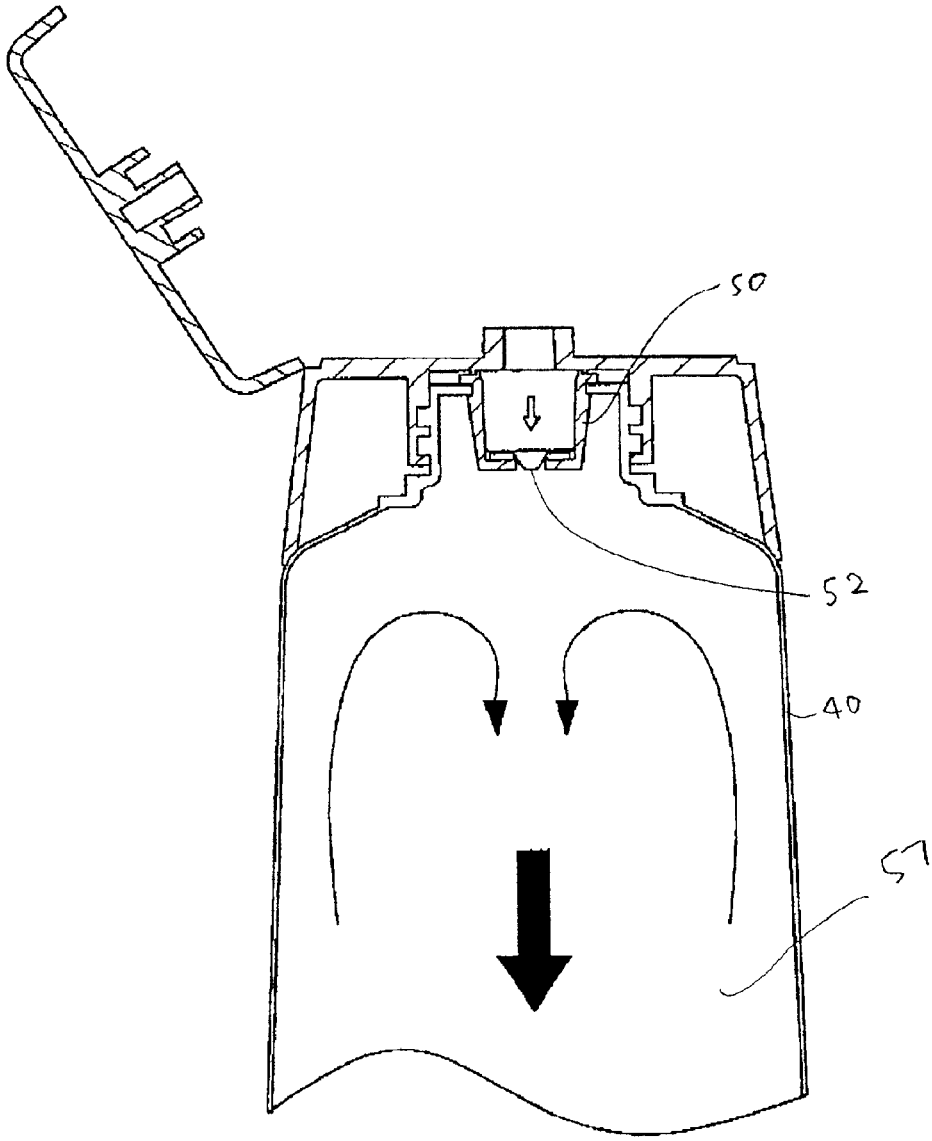
FIG. 9 is a schematic diagram showing the state of finishing discharging the fluid by the tube-type container according to the second embodiment of the present invention.
Figure 10A:
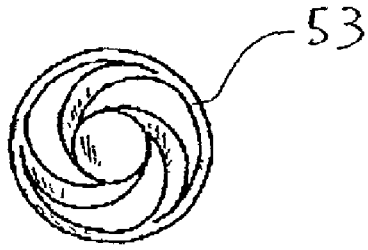
FIG. 10(*a*) is a top view of the valve body 51, and FIG. 10(*b*) is a cross sectional view showing an outline of the valve body 51 and the tube-shaped material 50.
Figure 10B:
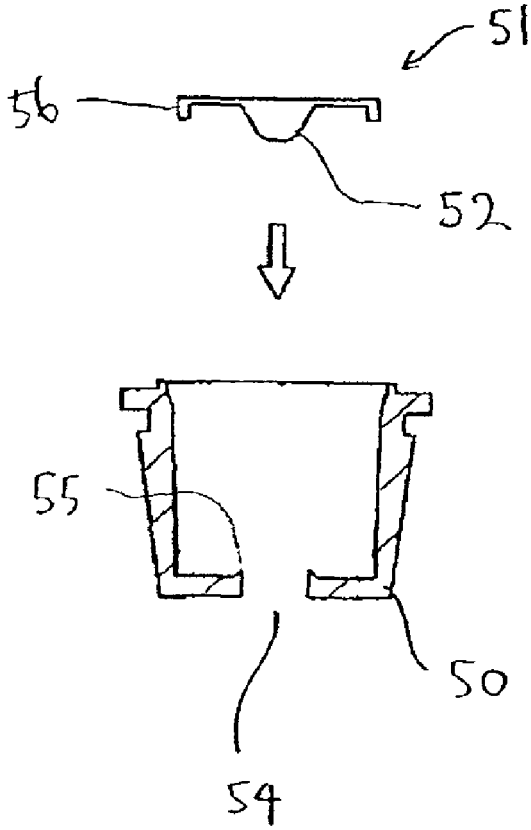
Figure 11:
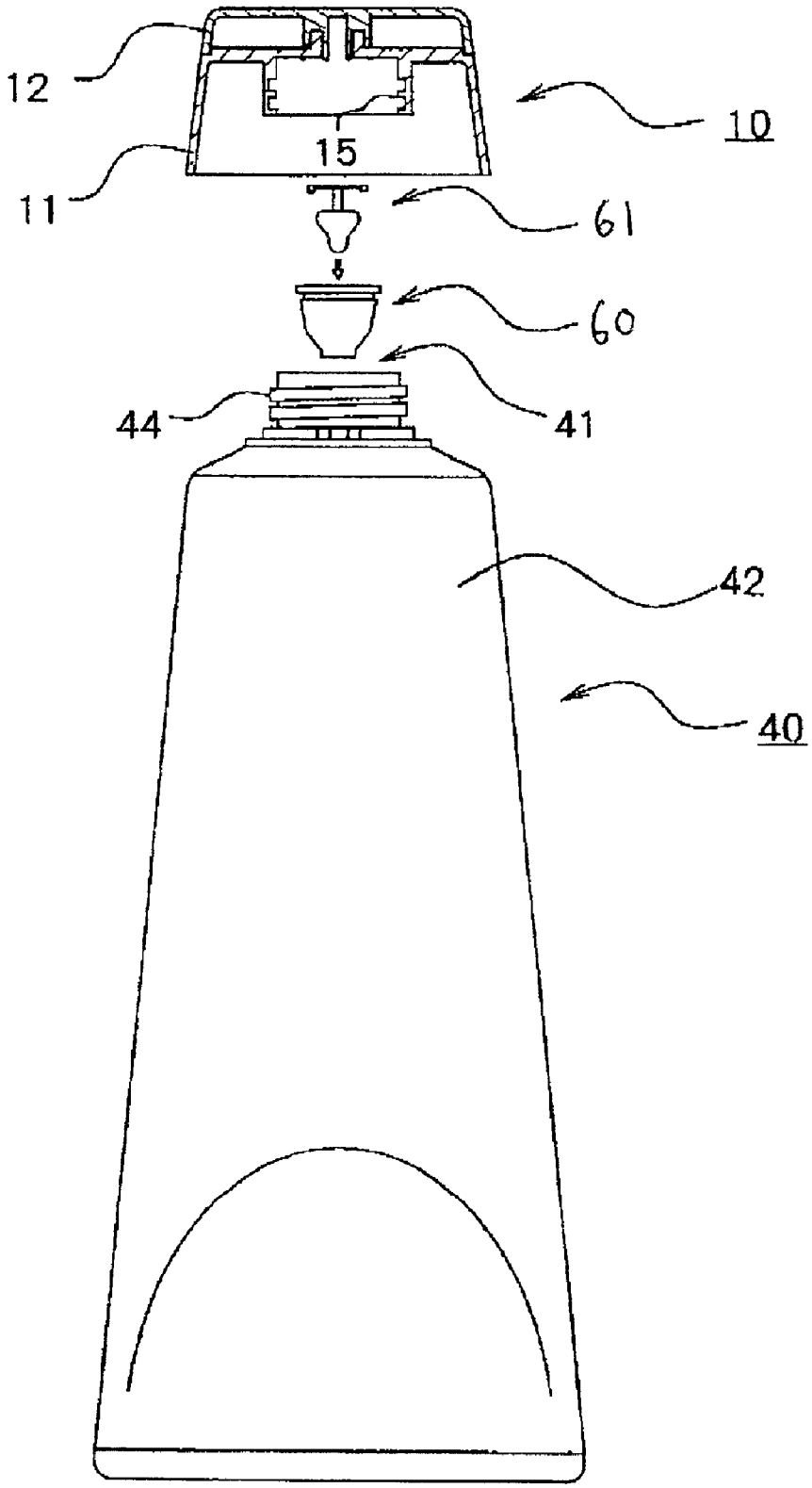
FIG. 11 is an exploded schematic diagram showing the tube-type container according to a third embodiment of the present invention.

FIG. 6 through FIG. 10(*b*) show a $2^{nd}$ embodiment. As shown in these figures, in the present invention, the support can be a perforated disc connected to a base of the convex portion, said disc being elastic and having a periphery attached to an inner wall of the cylinder-shaped material. In this embodiment, a cylinder-shaped material 50 has an opening 54 and is configured to be fitted in the mouth portion 41 of the main body 40 (FIG. 7). A perforated disc 53 and a convex portion 52 are integrated to form a valve portion 51 (FIGS. 10(*a*) and 10(*b*)). The periphery 56 of the disc 53 is fitted against an inner wall of the cylinder-shaped material 50 at the bottom of the cylinder-shaped material 50 (FIGS. 7 and 10). The disc 53 is elastic and allows the convex portion 52 to move in the axial direction when the fluid 57 passes through the opening 54 upon being squeezed by external force (FIG. 8). When the external force is released, backflow of the fluid instantaneously occurs due to elasticity-restoring function of the main body wherein the pressure of the fluid inside the main body 40 is lower than the pressure outside the main body 40, whereby the opening is closed by moving the convex portion 52 downward (FIG. 9). The disc 53 supports the convex portion 52 elastically and thus when the external force is released, the disc 53 is restored to the original position, thereby closing the opening 54 with the convex portion 52 (FIG. 9). In order to secure airtight contact between the convex portion 52 and the opening 54, an annular projection 55 can be formed along the edge of the opening 54 (FIGS. 10(*a*) and 10(*b*)). The disc 53 may be made of resilient resin.

Figure 12:
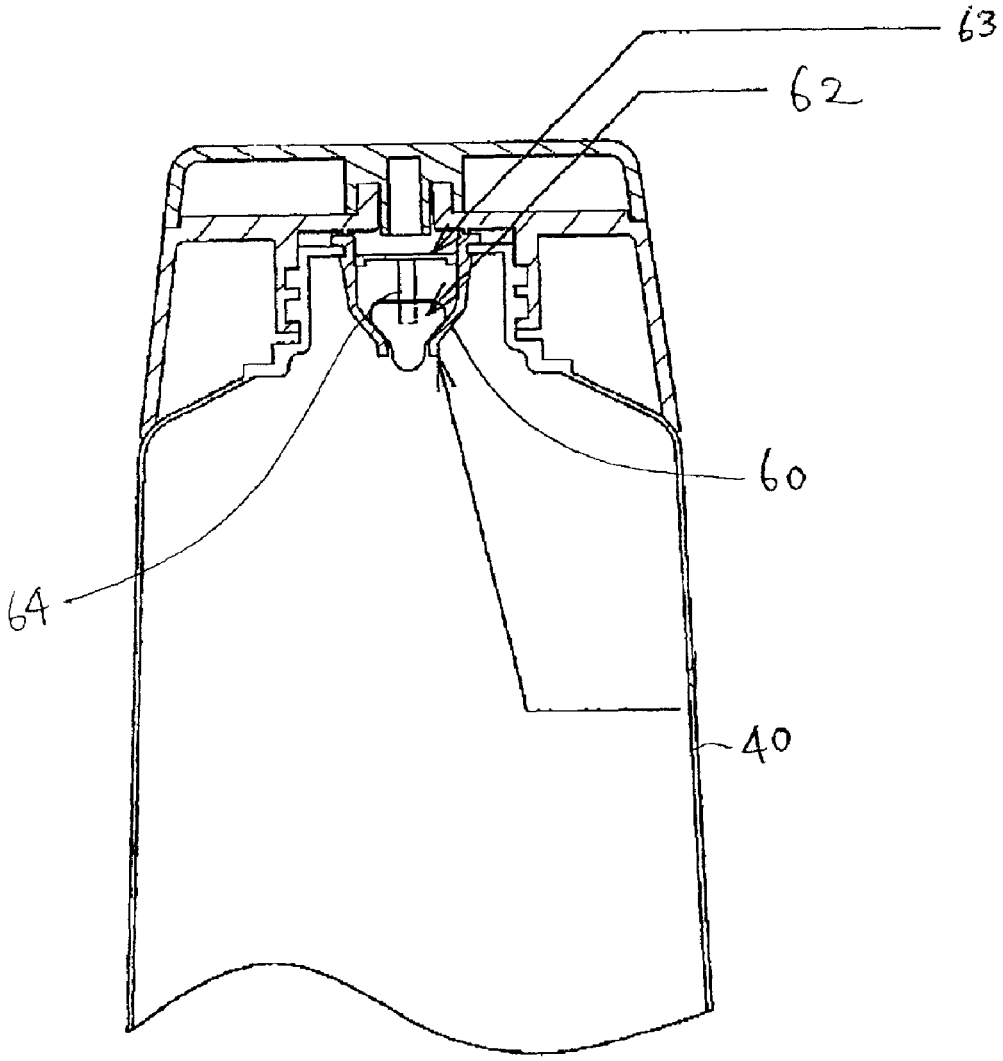
FIG. 12 is an enlarged view showing the tube-type container according to the third embodiment of the present invention.
Figure 13:
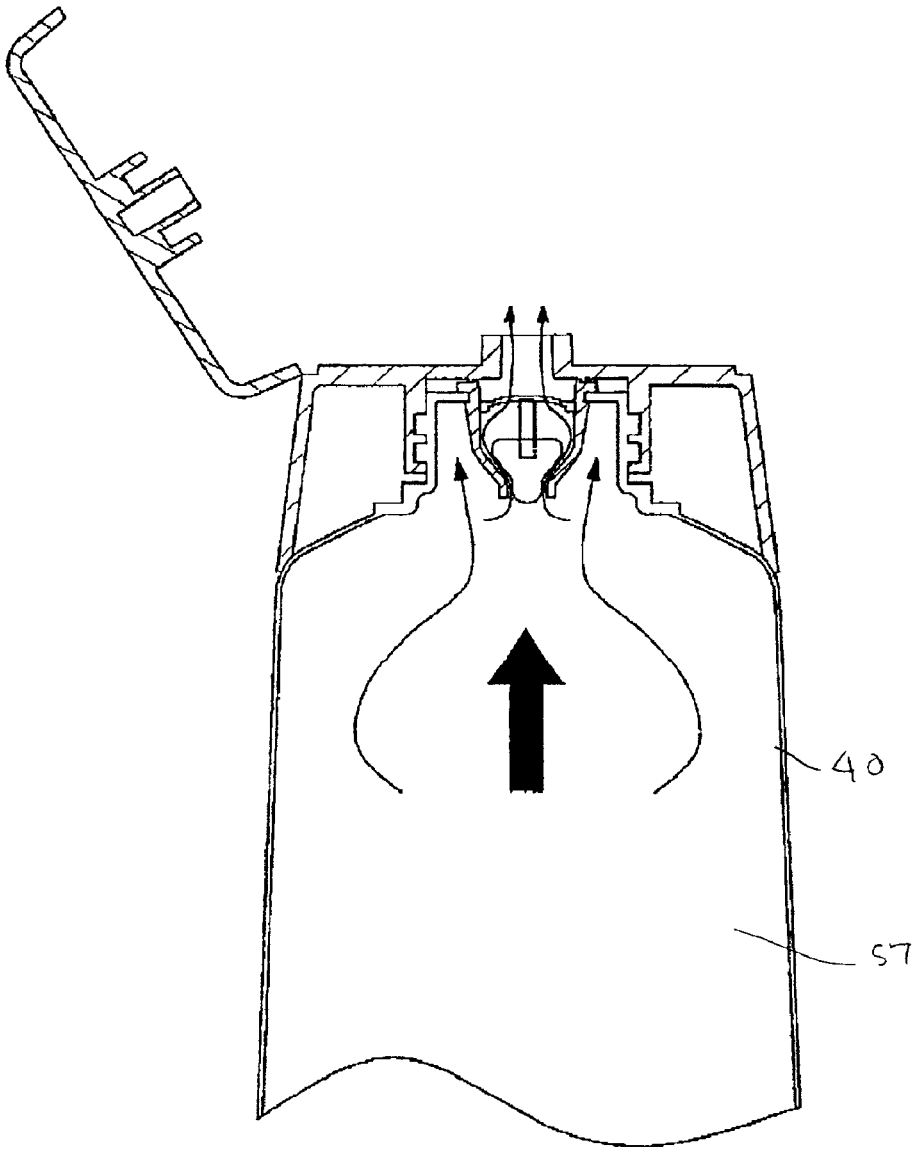
FIG. 13 is a schematic diagram showing the discharging movements of the fluid by the tube-type container according to the third embodiment of the present invention.
Figure 14:
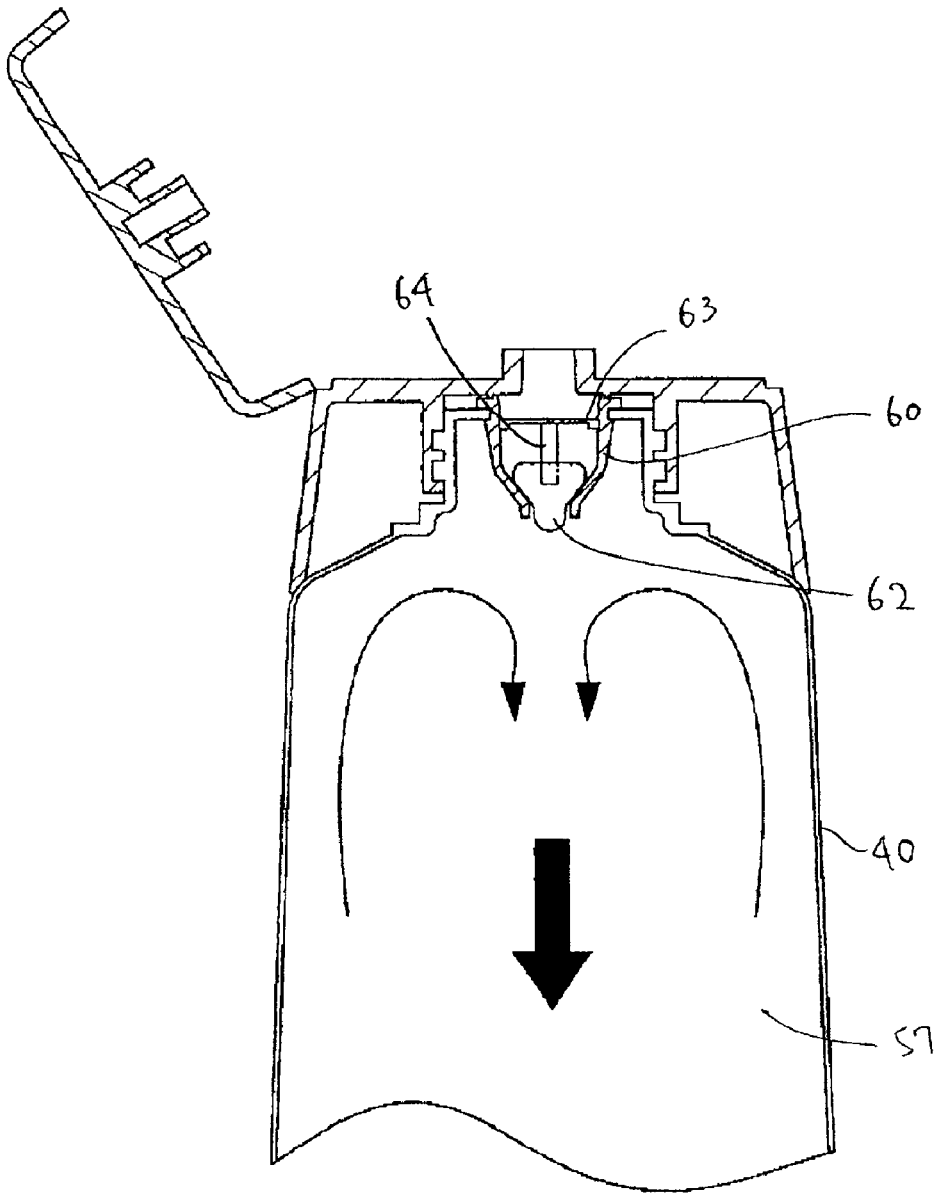
FIG. 14 is a schematic diagram showing the state of finishing discharging the fluid by the tube-type container according to the third embodiment of the present invention.
Figure 15A:
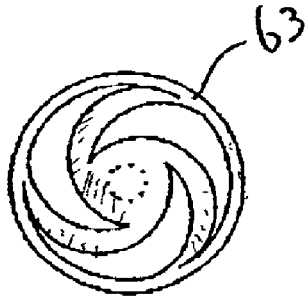
FIG. 15(*a*) is a top view of the valve body 61, and FIG. 15(*b*) is a cross sectional view showing an outline of the valve body 61 and the tube-shaped material 60.
Figure 15B:
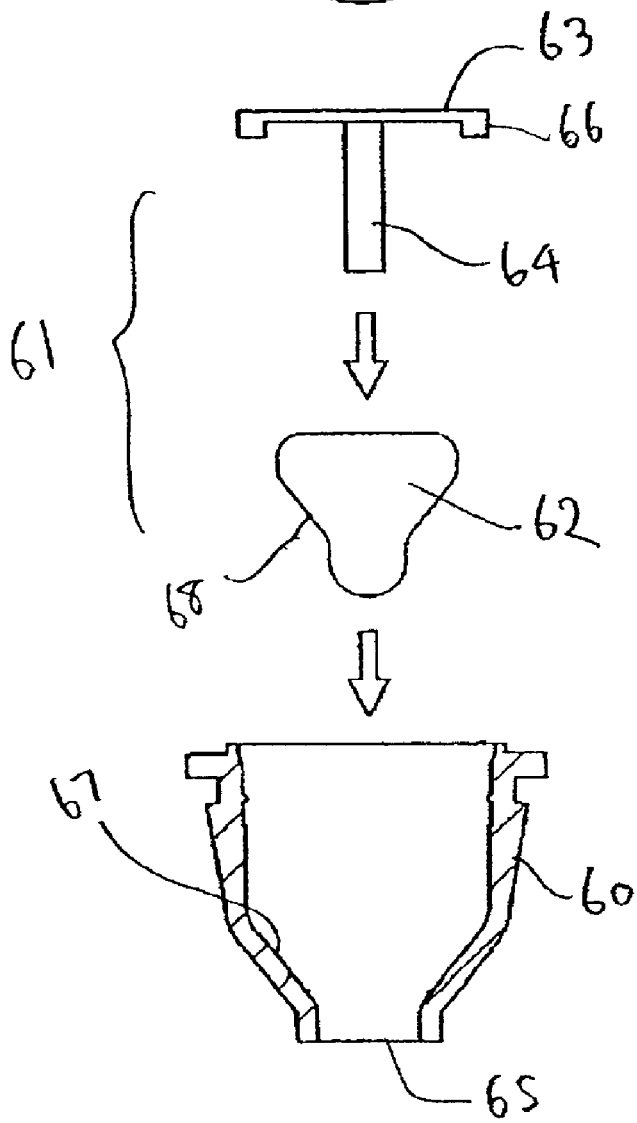
Figure 16:
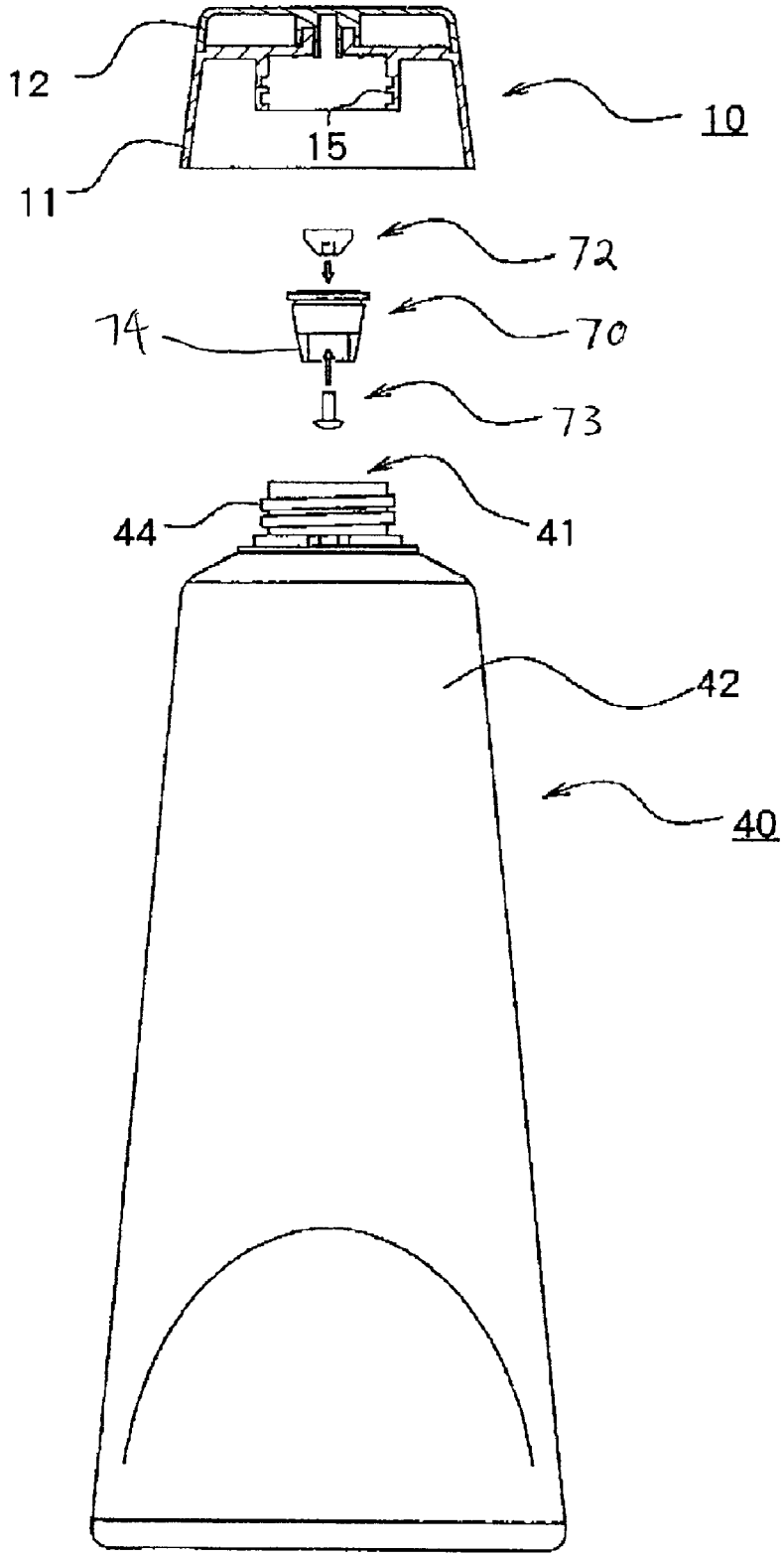
FIG. 16 is an exploded schematic diagram showing the tube-type container according to a fourth embodiment of the present invention.

In the above, the disc 53 is directly attached to the convex portion 52. However, in another embodiment, the disc may have a central projection attached to the base of the convex portion. FIGS. 11–15 show such an embodiment of the present invention (a $3^{rd}$ embodiment). In this embodiment, a cylinder-shaped material 60 has an opening 65 and is configured to be fitted in the mouth portion 41 of the main body 40 (FIG. 12). A perforated disc 63 and a convex portion 62 are integrated via central projection 64 to form a valve portion 61 (FIGS. 12 and 15). The periphery 66 of the disc 63 is fitted against an inner wall of the cylinder-shaped material 60 at an upper portion of the cylinder-shaped material 60 (FIGS. 12 and 15). The disc 63 is elastic and allows via the central projection 64 the convex portion 62 to move in the axial direction when the fluid 57 passes through the opening 65 upon being squeezed by external force (FIG. 13). When the external force is released, backflow of the fluid instantaneously occurs due to elasticity-restoring function of the main body wherein the pressure of the fluid inside the main body 40 is lower than the pressure outside the main body 40, whereby the opening is closed by moving the convex portion 62 downward (FIG. 14). The disc 63 supports via the central projection 64 the convex portion 62 elastically and thus when the external force is released, the disc 63 is restored to the original position, thereby closing the opening 65 with the convex portion 62 (FIG. 14). In order to secure airtight contact between the convex portion 62 and the opening 65, the cylinder-shaped material 60 may have a tapered annular surface 67 formed along the opening 65 (FIG. 15) so that a tapered surface 68 of the convex portion 62 can be fitted against the tapered annular surface 67. The disc 63 may be made of resilient resin.

Figure 17:
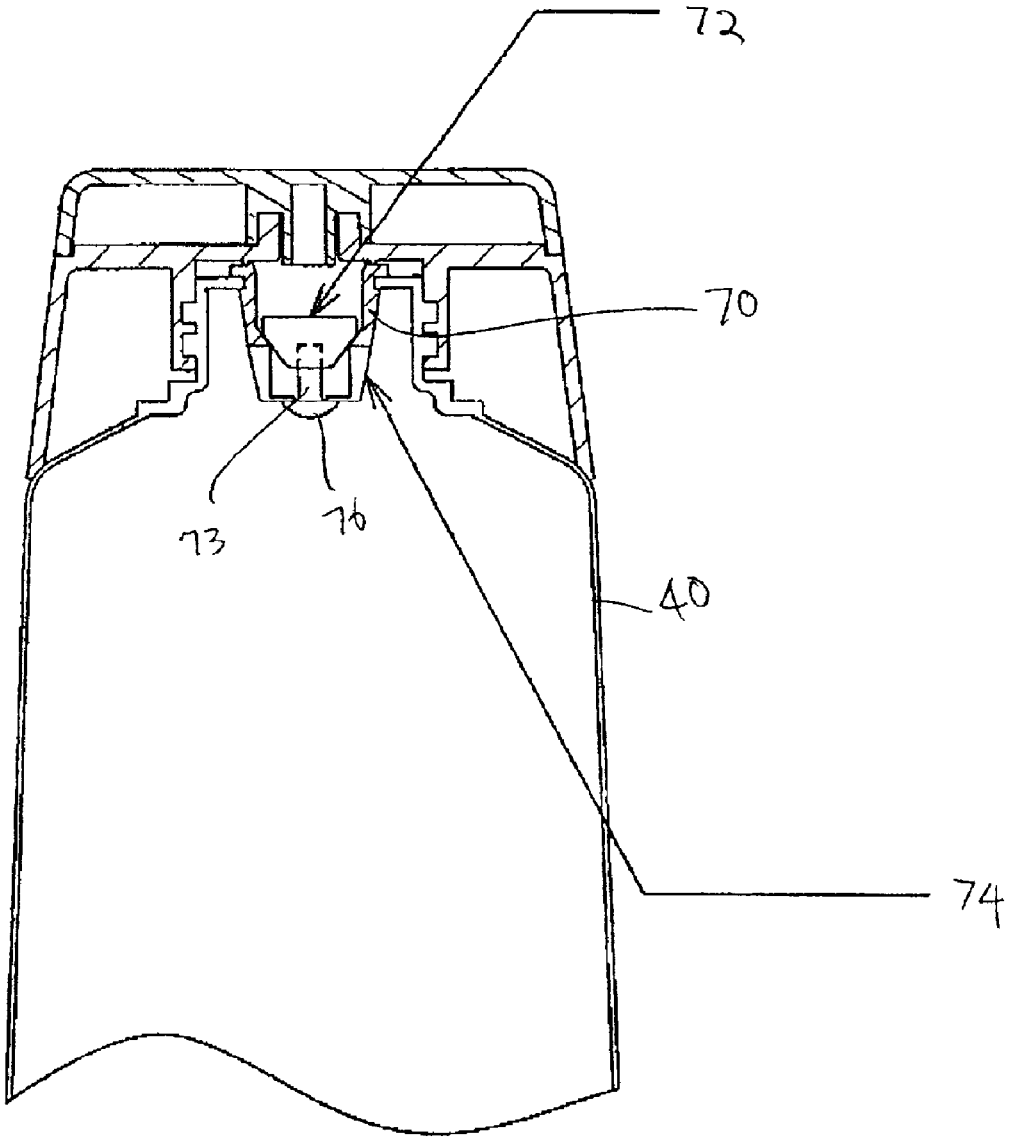
FIG. 17 is an enlarged view showing the tube-type container according to the fourth embodiment of the present invention.
Figure 18:
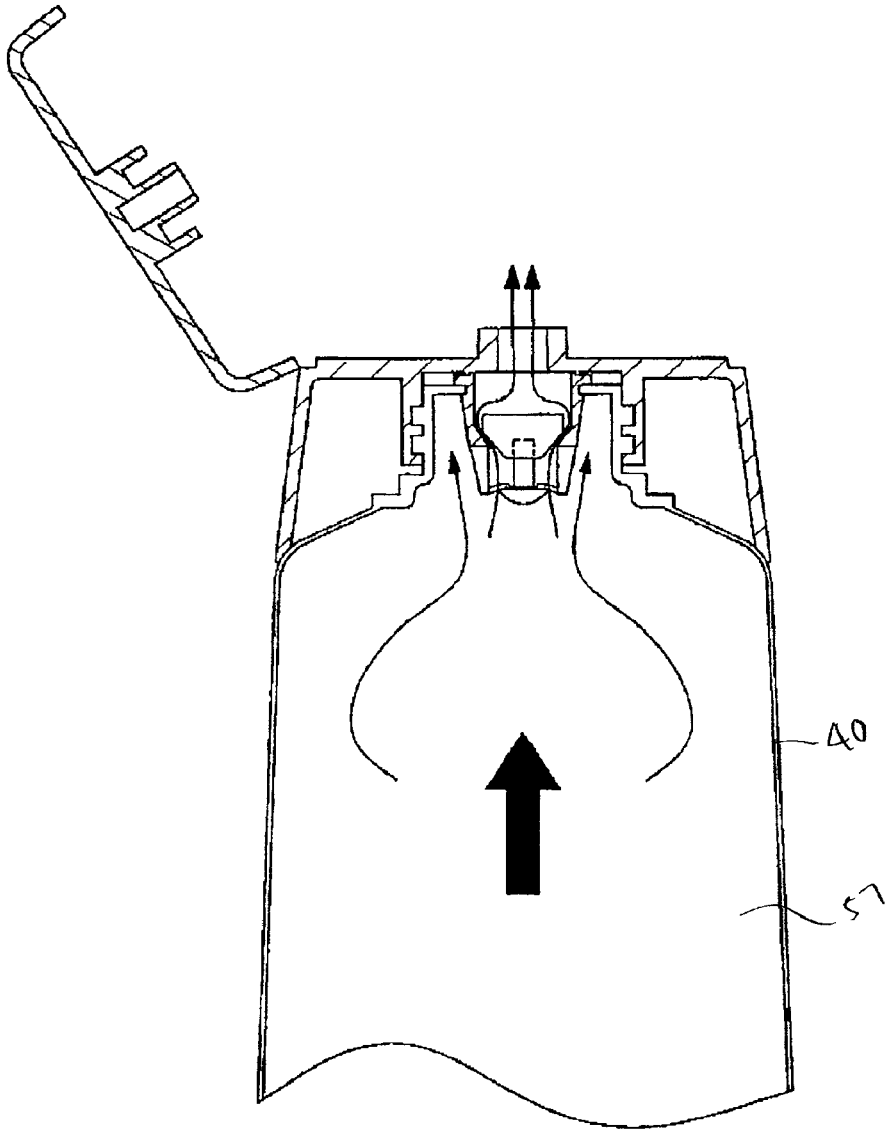
FIG. 18 is a schematic diagram showing the discharging movements of the fluid by the tube-type container according to the fourth embodiment of the present invention.
Figure 19:
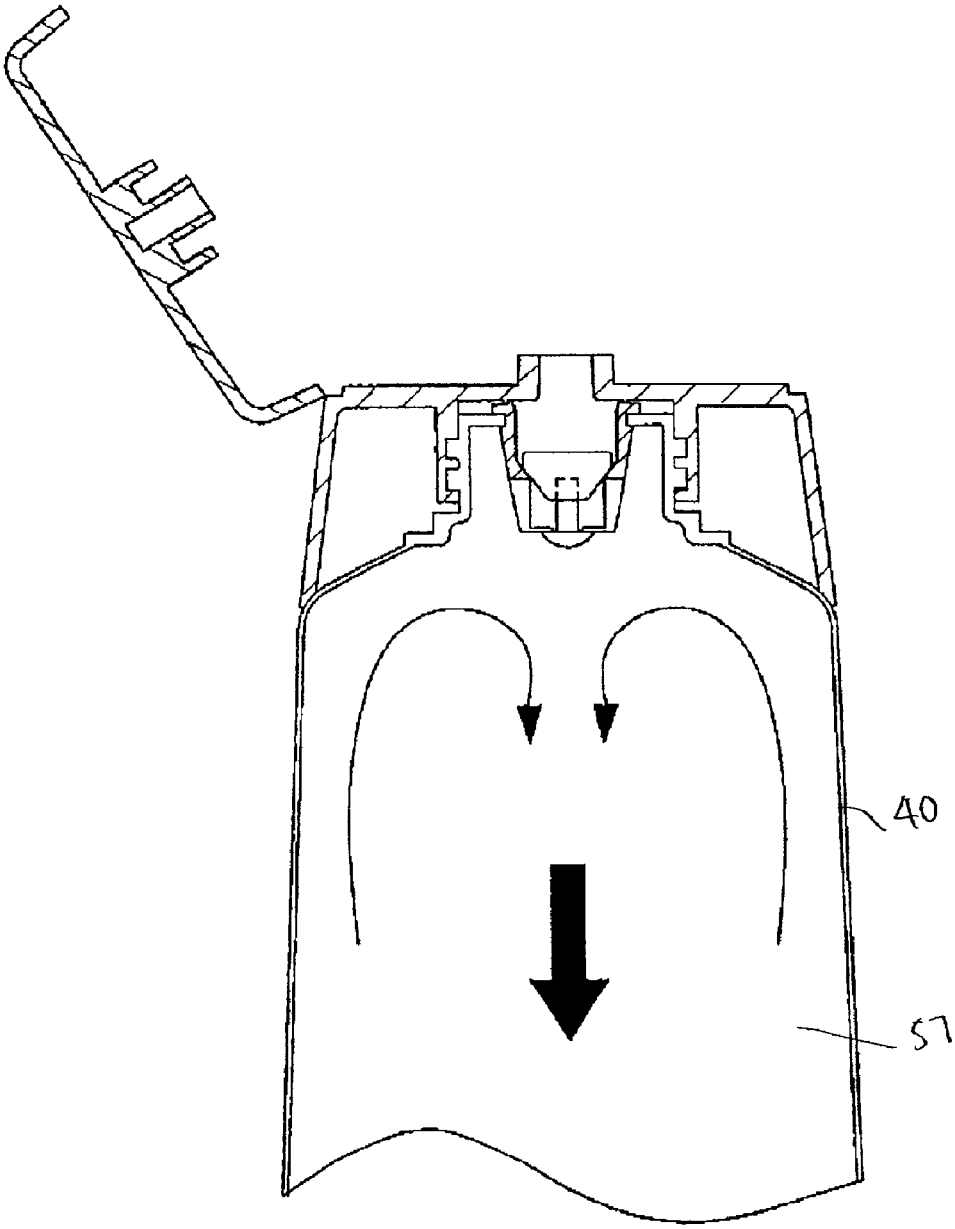
FIG. 19 is a schematic diagram showing the state of finishing discharging the fluid by the tube-type container according to the fourth embodiment of the present invention.
Figure 20A:
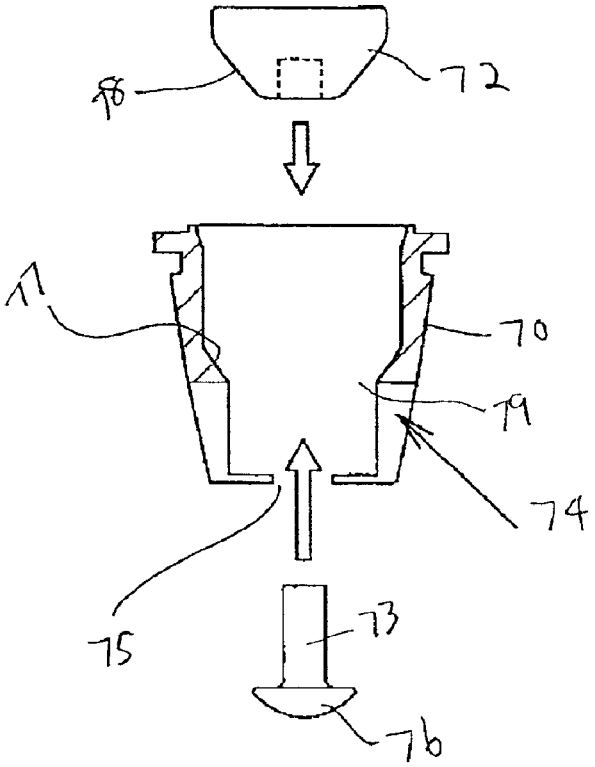
FIG. 20(*a*) is a cross sectional view showing an outline of the valve body 72 and 73 and the tube-shaped material 70, and FIG. 20(*b*) is a bottom view of the valve body.
Figure 20B:
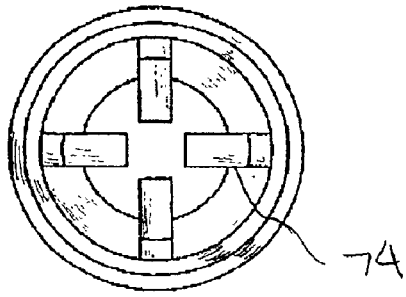
Figure 21:
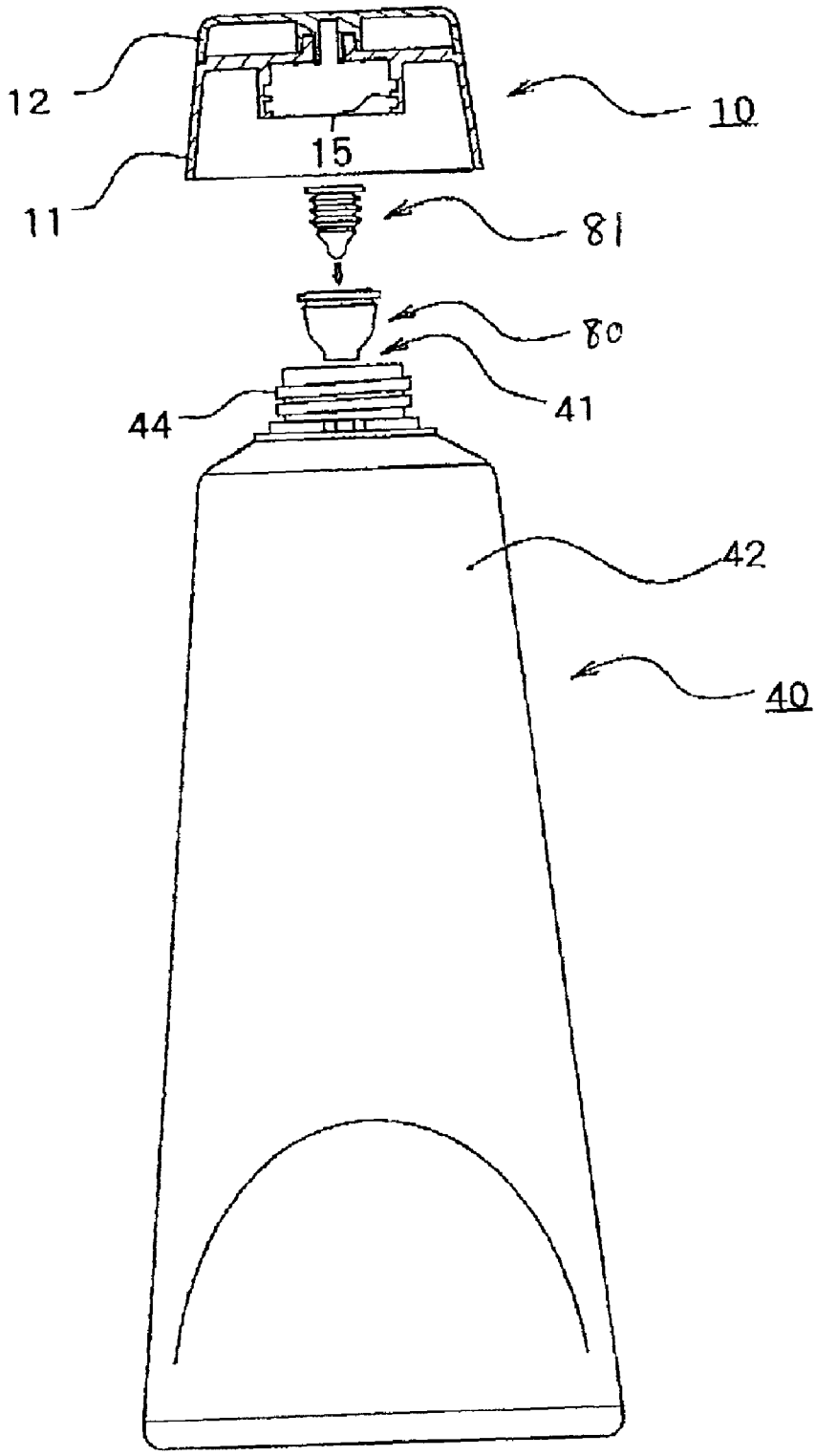
FIG. 21 is an exploded schematic diagram showing the tube-type container according to a fifth embodiment of the present invention.

In the above, the disc 53 or 63 functions as a support. However, in another embodiment, the support can be configured differently and comprise (i) a perforated elastic cylindrical member attached under the cylinder-shaped material and having a central opening, and (ii) a connecting member having a head having a larger diameter than a diameter of the central opening, wherein an end of said connecting member opposite to the head is inserted through the central opening and attached to a tip of the convex portion. FIGS. 16–20 show such an embodiment of the present invention (a $4^{th}$ embodiment). In this embodiment, a cylinder-shaped material 70 is configured to be fitted in the portion 41 of the main body 40, and a perforated elastic cylindrical member 74 having a central opening 75 is attached under the cylinder-shaped material 70 (FIGS. 17 and 20). A connecting member 73 is inserted through the central opening 75 and connected to a convex portion 72 (FIG. 17). The connecting member 73 has a head 76 having a larger diameter than a diameter of the central opening 75 so that movement of the cylinder-shaped material 72 is limited. The perforated elastic cylindrical member 74 is elastic and allows the convex portion 72 to move in the axial direction when the fluid 57 passes through the opening 75 upon being squeezed by external force (FIG. 18). When the external force is released, backflow of the fluid instantaneously occurs due to elasticity-restoring function of the main body wherein the pressure of the fluid inside the main body 40 is lower than the pressure outside the main body 40, whereby the opening is closed by moving the convex portion 72 downward (FIG. 19). The connecting member 73 supports via the perforated elastic cylindrical member 74 the convex portion 72 elastically and thus when the external force is released, the perforated elastic cylindrical member 74 is restored to the original position, thereby closing an opening 79 with the convex portion 72 (FIG. 19). In order to secure airtight contact between the convex portion 72 and the opening 79, the cylinder-shaped material 70 may have a tapered annular surface 77 formed along the opening 79 (FIG. 20) so that a tapered surface 78 of the convex portion 72 can be fitted against the tapered annular surface 77. The perforated elastic cylindrical member 74 may be made of resilient resin.

Figure 22:
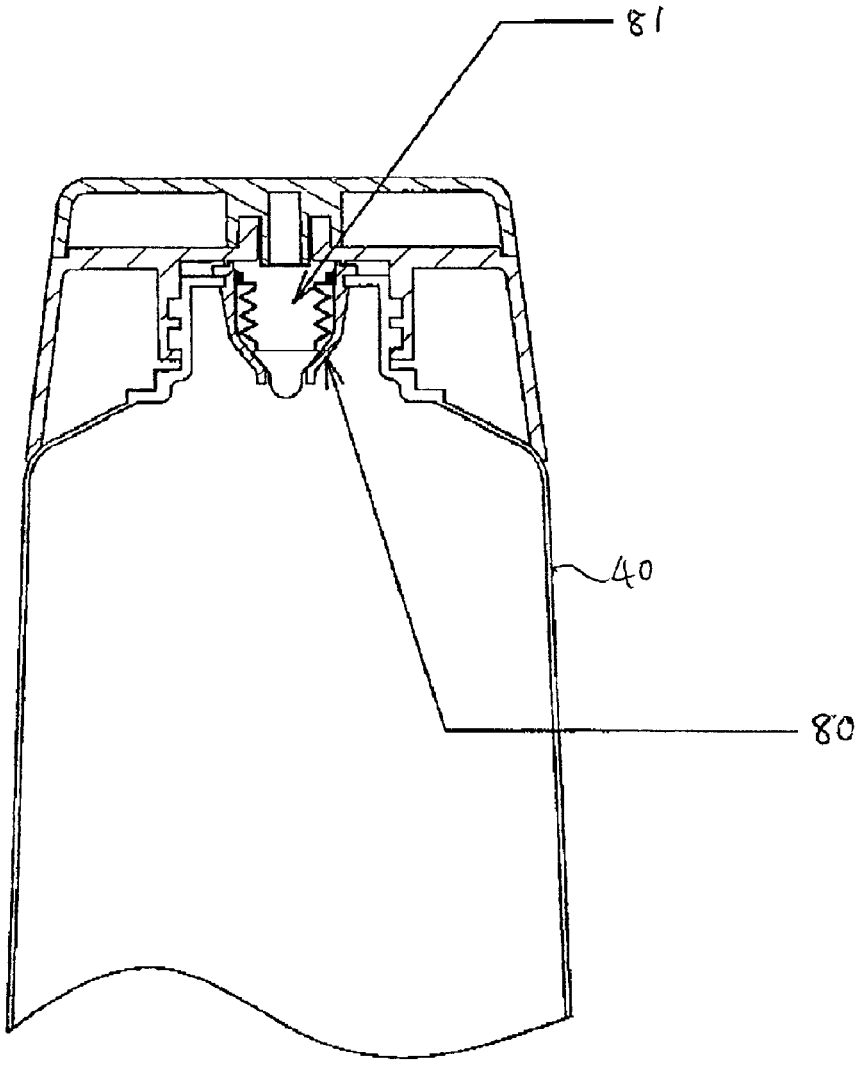
FIG. 22 is an enlarged view showing the tube-type container according to the fifth embodiment of the present invention.
Figure 23:
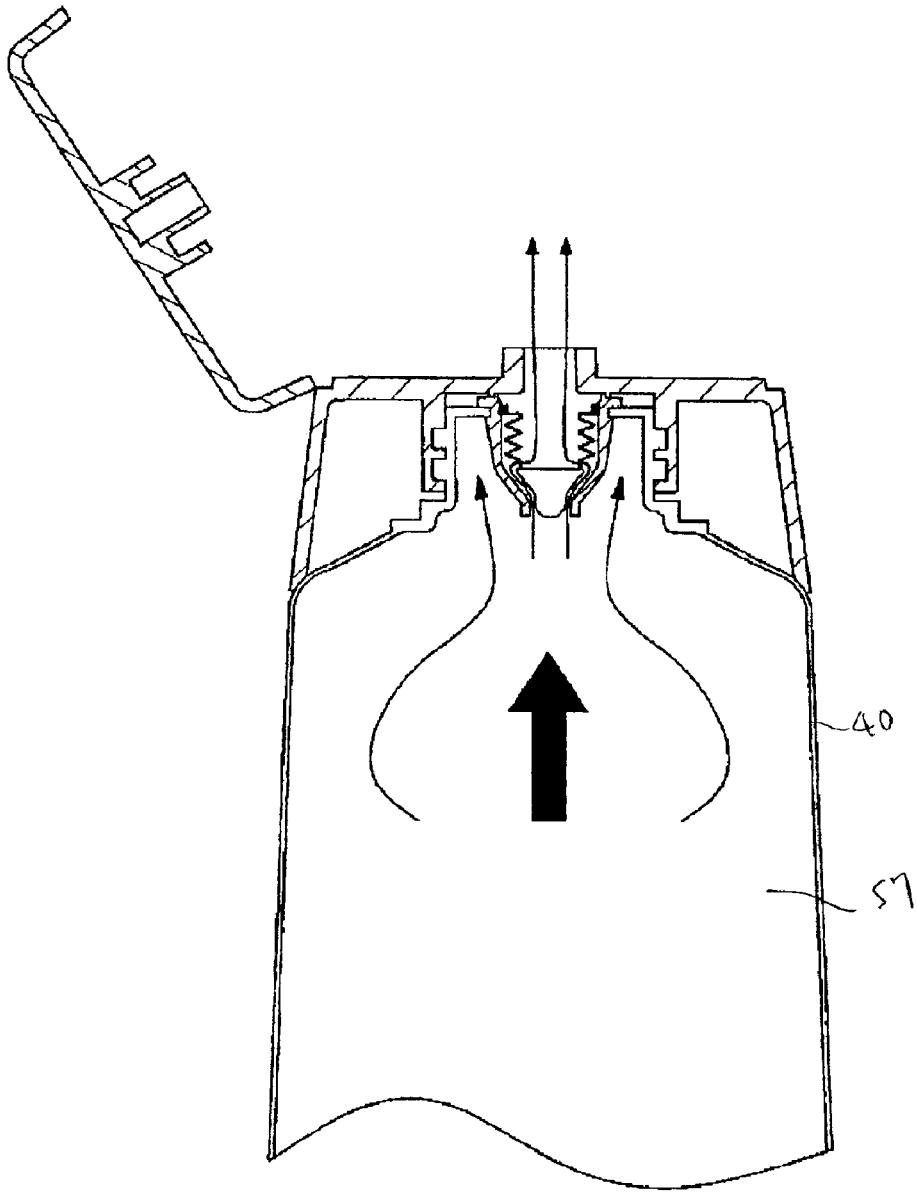
FIG. 23 is a schematic diagram showing the discharging movements of the fluid by the tube-type container according to the fifth embodiment of the present invention.
Figure 24:
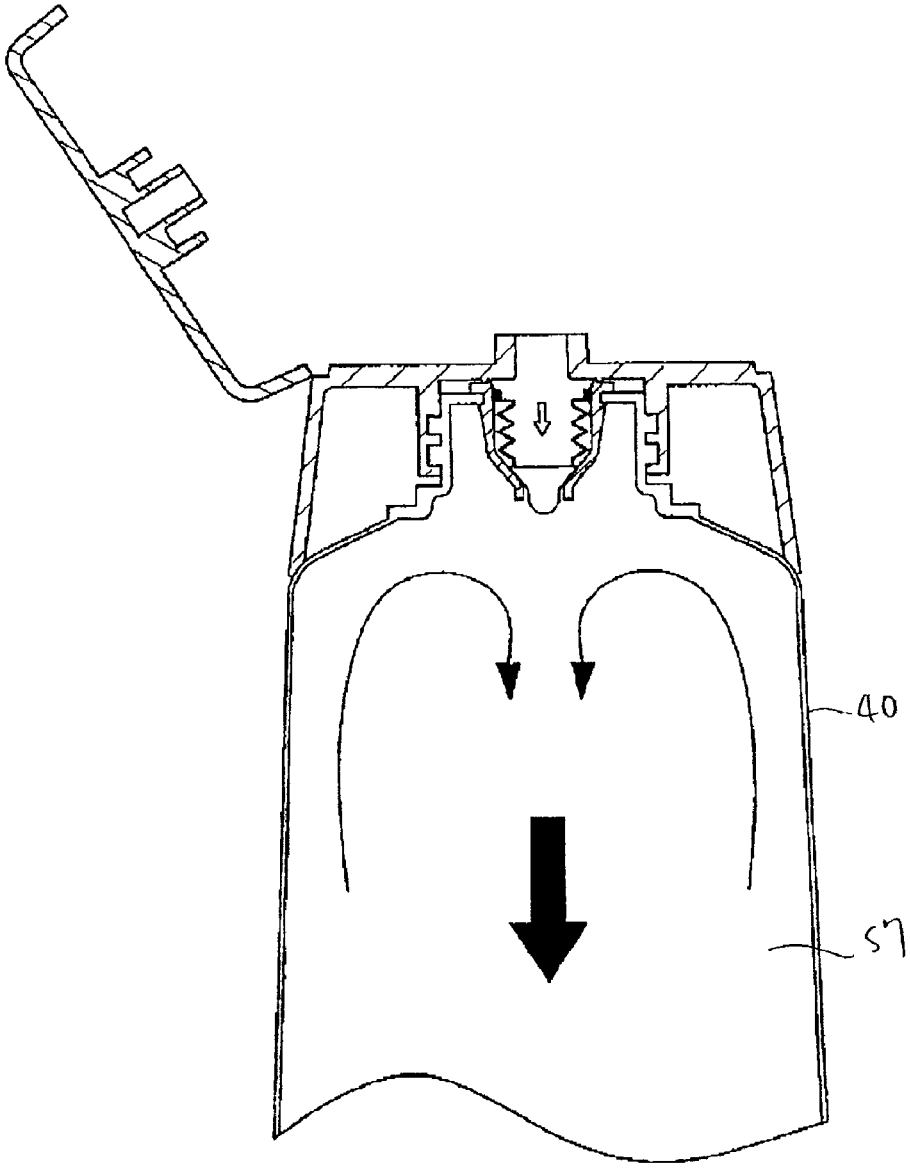
FIG. 24 is a schematic diagram showing the state of finishing discharging the fluid by the tube-type container according to the fifth embodiment of the present invention.
Figure 25:
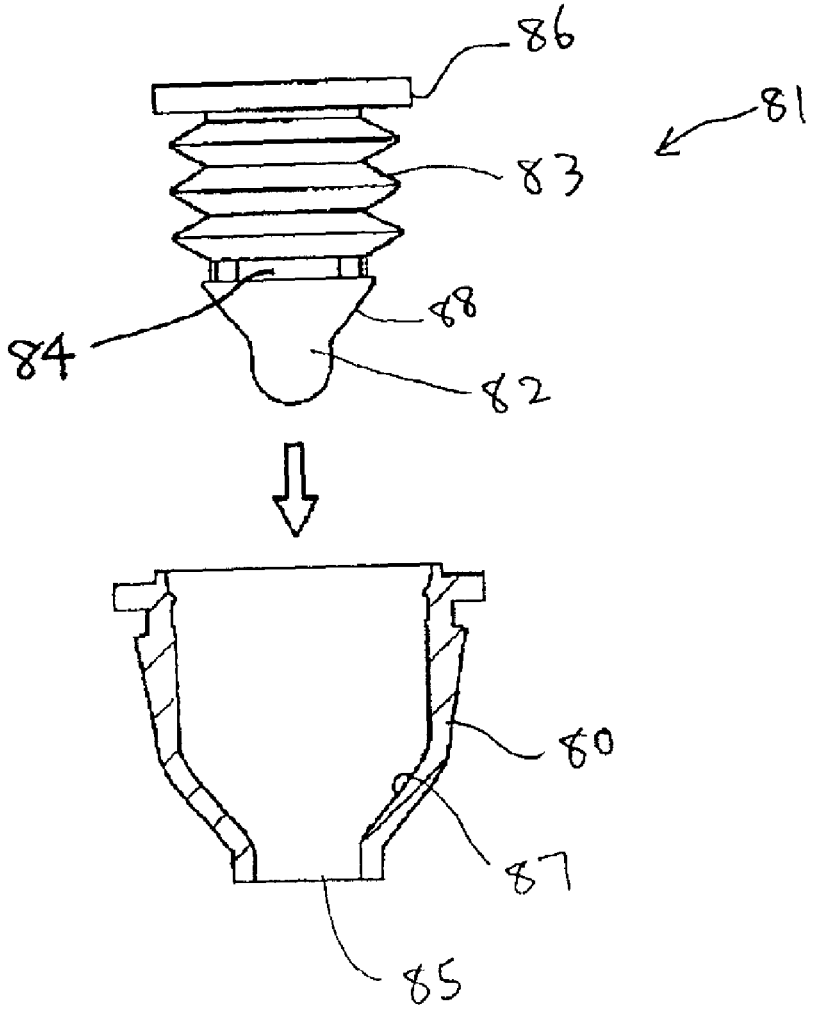
FIG. 25 is an enlarged view showing an outline of the valve body 81 and the tube-shaped material 80.
Figure 26:
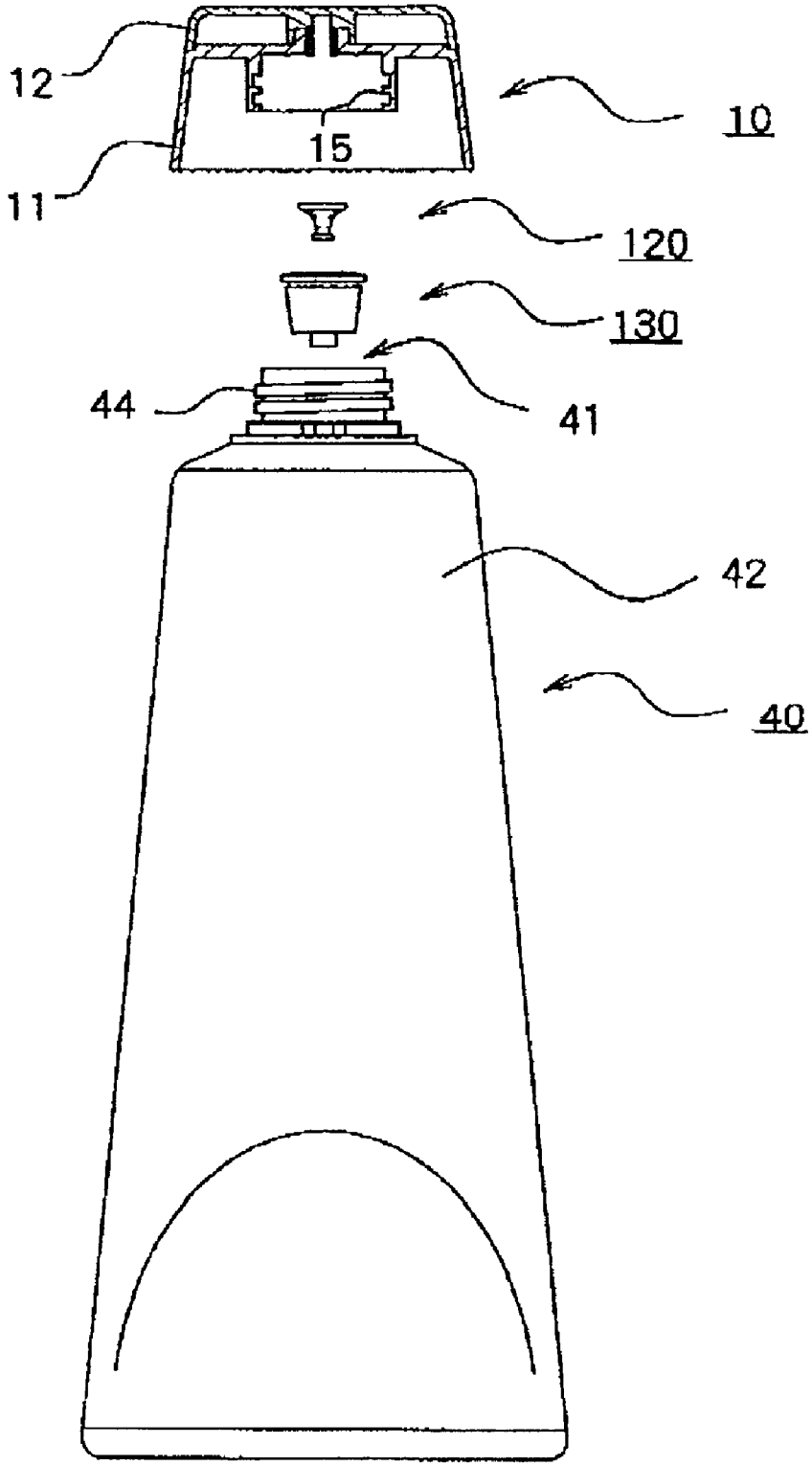
FIG. 26 is an exploded schematic diagram showing the tube-type container according to a sixth embodiment of the present invention.

In an embodiment, a support can be bellows having two ends, one end being attached to an inner wall of the cylinder-shaped material, the other end being attached to a base of the convex portion. FIGS. 21–25 show such an embodiment of the present invention (a $5^{th}$ embodiment). In this embodiment, a cylinder-shaped material 80 has an opening 85 and is configured to be fitted in the mouth portion 41 of the main body 40 (FIG. 22). Bellows 83 and a convex portion 82 are integrated to form a valve portion 81 (FIGS. 22 and 25). An upper periphery 86 of the bellows 83 is fitted against an inner wall of the cylinder-shaped material 80 at an upper portion of the cylinder-shaped material 80 (FIGS. 22 and 25). The bellows 83 are elastic and allow the convex portion 82 to move in the axial direction when the fluid 57 passes through the opening 85 upon being squeezed by external force (FIG. 23). The liquid then passes through a gap 84 and is discharged from the mouth (FIG. 25). When the external force is released, backflow of the fluid instantaneously occurs due to elasticity-restoring function of the main body wherein the pressure of the fluid inside the main body 40 is lower than the pressure outside the main body 40, whereby the opening is closed by moving the convex portion 82 downward (FIG. 24). The bellows 83 support the convex portion 82 elastically and thus when the external force is released, the bellows 83 are restored to the original position, thereby closing the opening 85 with the convex portion 82 (FIG. 24). In order to secure airtight contact between the convex portion 82 and the opening 85, the cylinder-shaped material 80 may have a tapered annular surface 87 formed along the opening 85 (FIG. 25) so that a tapered surface 88 of the convex portion 82 can be fitted against the tapered annular surface 87. The bellows 83 maybe made of resilient resin.

In the above-described embodiments, the container may further comprise a lid portion 10 comprising a lid body 12 and a lid base 11, wherein the lid base 11 is attached to the mouth portion 41 of the main body 40 and fixes the cylinder-shaped material interposed between the lid base 11 and the mouth portion 41. The lid base 11 has a throughhole 13 through which the fluid 57 is discharged. The lid body 12 closes the throughhole 13 by press fitting to the lid base 11.

In an embodiment, the mouth portion 41 and the lid base 11 have screw threads 44 and 15 for fitting together, wherein the cylinder-shaped material is fixed therebetween.

The main body 40 may be made of a plastic laminate material. The fluid to be stored may be a viscous liquid.

Figure 27:
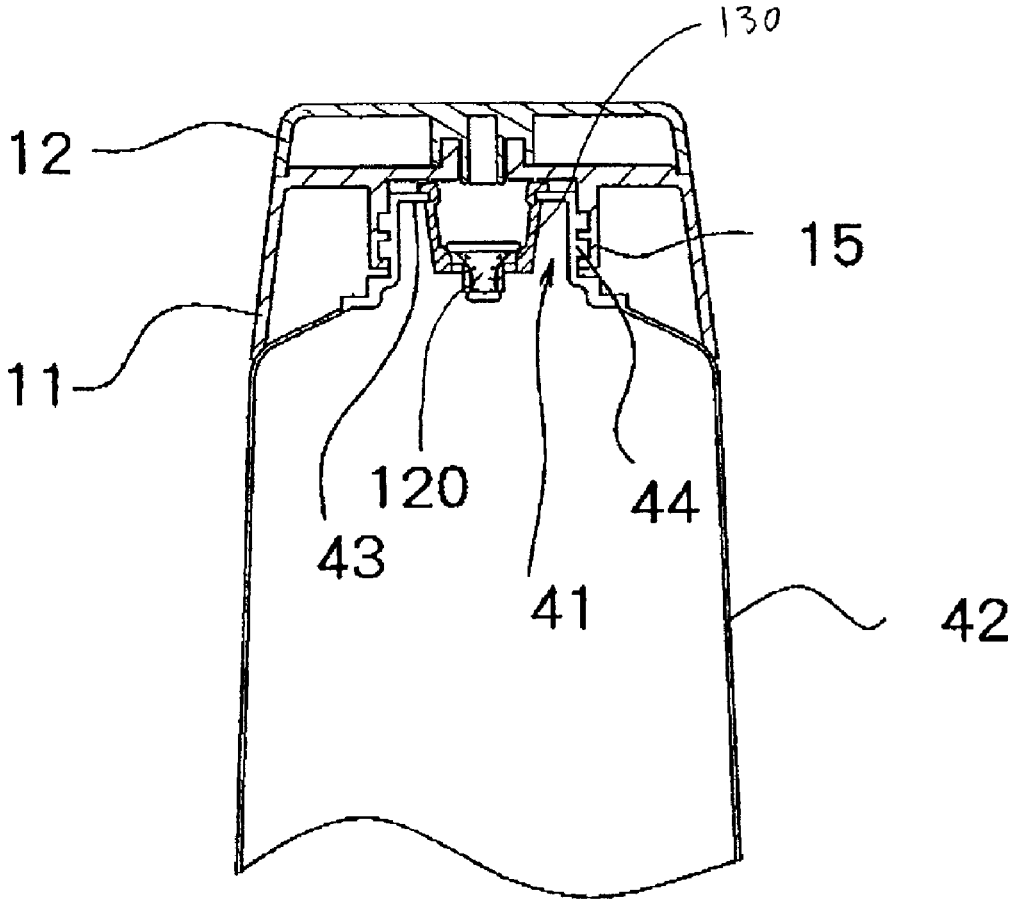
FIG. 27 is an enlarged view showing the tube-type container according to the sixth embodiment of the present invention.
Figure 28:
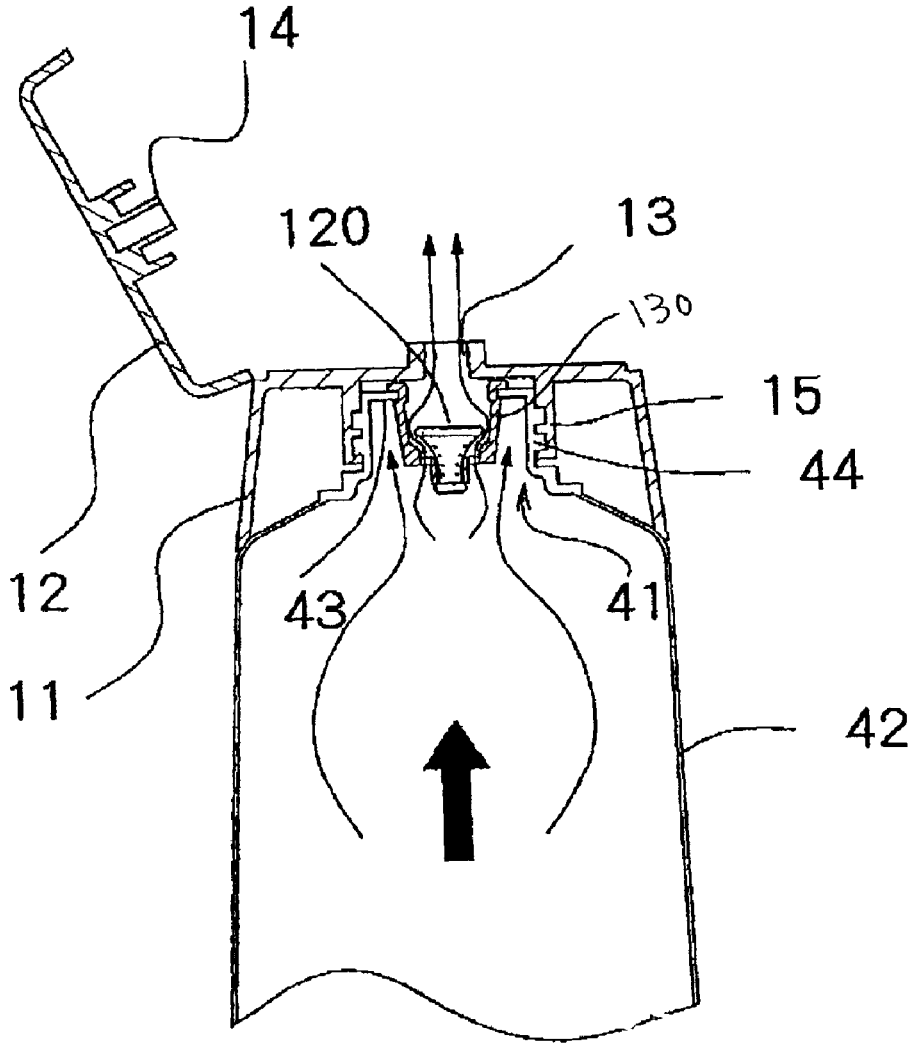
FIG. 28 is a schematic diagram showing the discharging movements of the fluid by the tube-type container according to the sixth embodiment of the present invention.
Figure 29:
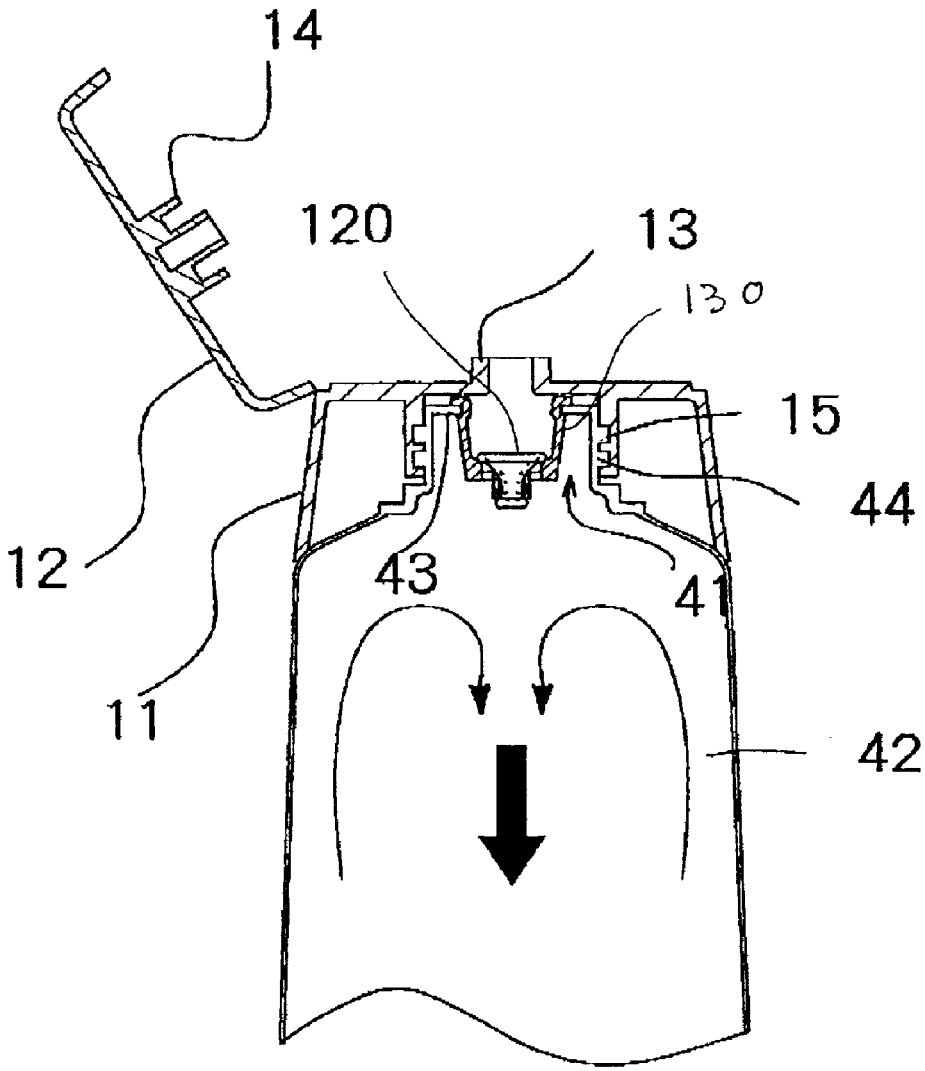
FIG. 29 is a schematic diagram showing the state of finishing discharging the fluid by the tube-type container according to the sixth embodiment of the present invention.
Figure 30A:
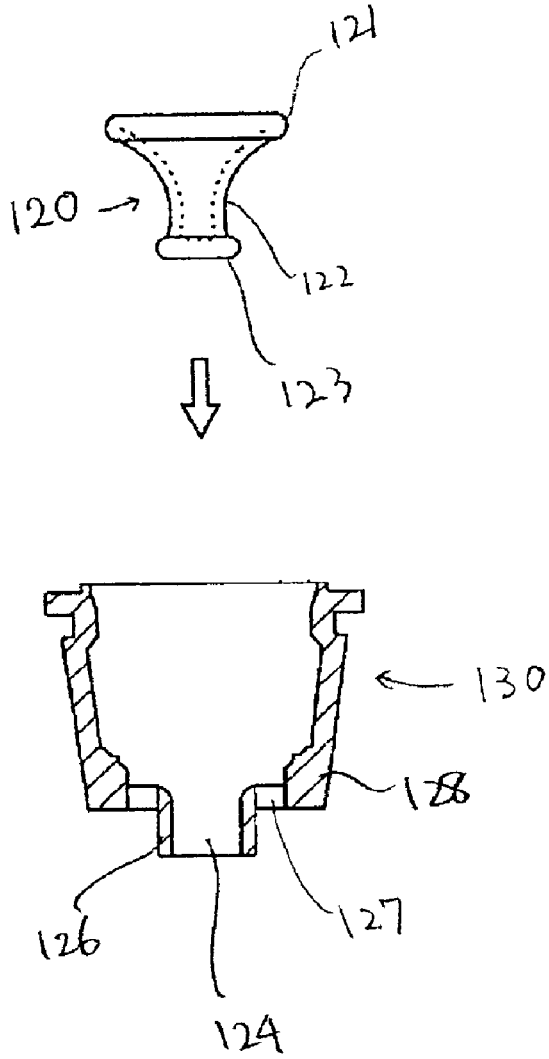
FIG. 30(*a*) is a cross sectional view showing an outline of the valve body 120 and the tube-shaped material 130, and FIG. 30(*b*) is a bottom view of the valve body.
Figure 30B:
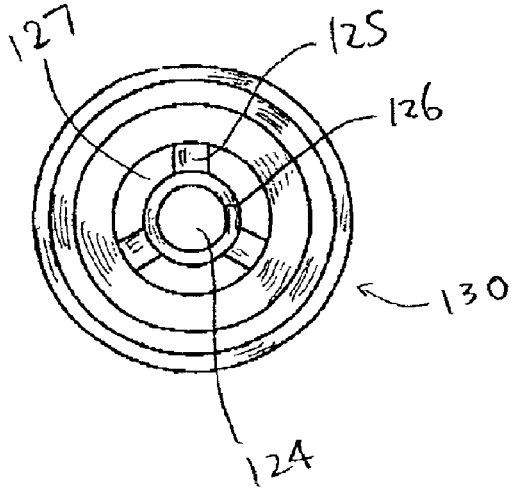
Figure 31:
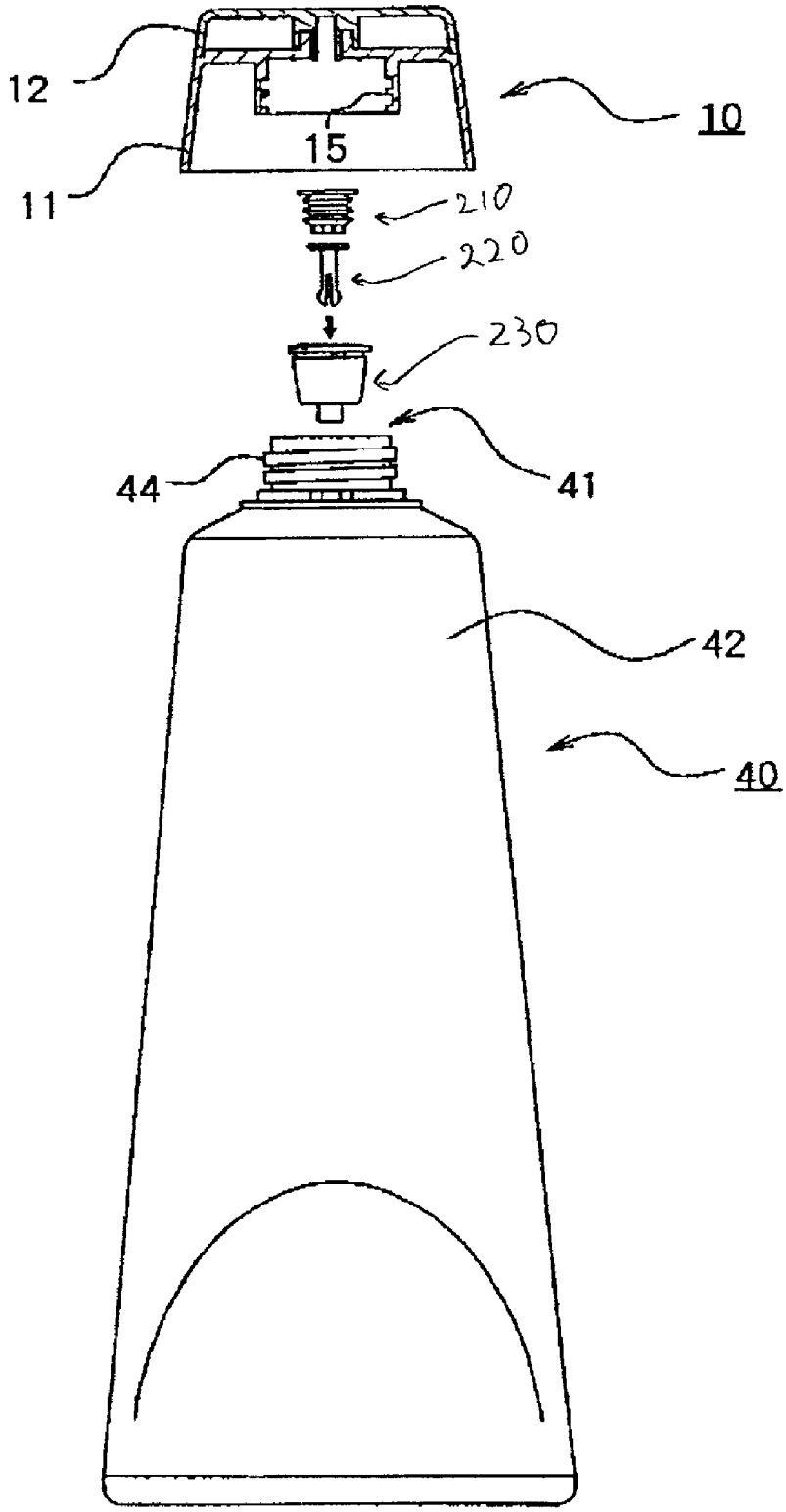
FIG. 31 is an exploded schematic diagram showing the tube-type container according to a seventh embodiment of the present invention.

The present invention is not limited to the above embodiments and further includes, but is not limited to, the following embodiments:

In other embodiments, a valve body can be made of a resilient material such as a rubber (e.g., silicon rubber or other resilient resin), so that the movement of the valve body for discharging the liquid through an opening can be accomplished by resilience or elasticity of the valve body, instead of entire physical movement of the valve body. FIGS. 26–30 show such an embodiment of the present invention (a $6^{th}$ embodiment). In this embodiment, a cylinder-shaped material 130 has a central opening 124 and is configured to be fitted in the mouth portion 41 of the main body 40 (FIG. 27). A valve body 120 is made of silicon rubber and has a recess in the center (a trumpet shape). That is, the valve body comprises an upper flange 121, a lower flange 123, and a convex portion 122 (FIG. 30(*a*)). The lower flange 123 is inserted through the central opening 124 of the cylinder-shaped material 120 (FIG. 30(*b*)). The central opening 124 is formed by a ring 126 which is supported by a support 125 attached to a cylinder-shaped body 128. The liquid passes through a side opening 127. The lower flange 123 is fixed at the edge of the ring 126, and when the main body 42 is pressed by external force (FIG. 28), the liquid passes through the side opening 127 and pushes the convex portion 122 upward, thereby causing the valve body 120 to be deformed and stretched in a direction of the liquid (in the axial direction). When the external force is released, backflow of the fluid instantaneously occurs due to elasticity-restoring function of the main body wherein the pressure of the fluid inside the main body 40 is lower than the pressure outside the main body 40, whereby the side opening 127 is closed by moving the convex portion 122 downward (FIG. 29). The upper flange 121 fits against an inner surface of the cylinder-shaped body 128 and prevents the convex portion 122 from being disengaged from the ring 126. The convex portion is elastic and thus when the external force is released, the convex portion 122 are restored to the original position, thereby closing the side opening 127 (FIGS. 29 and 30(*a*)(*b*)). In order to secure airtight contact between the convex portion 122 and the side opening 127, the cylinder-shaped material 120 may have a tapered annular surface formed around the side opening 127 (FIG. 30(*a*)) so that a tapered surface of the convex portion can be fitted against the tapered annular surface.

Figure 32:
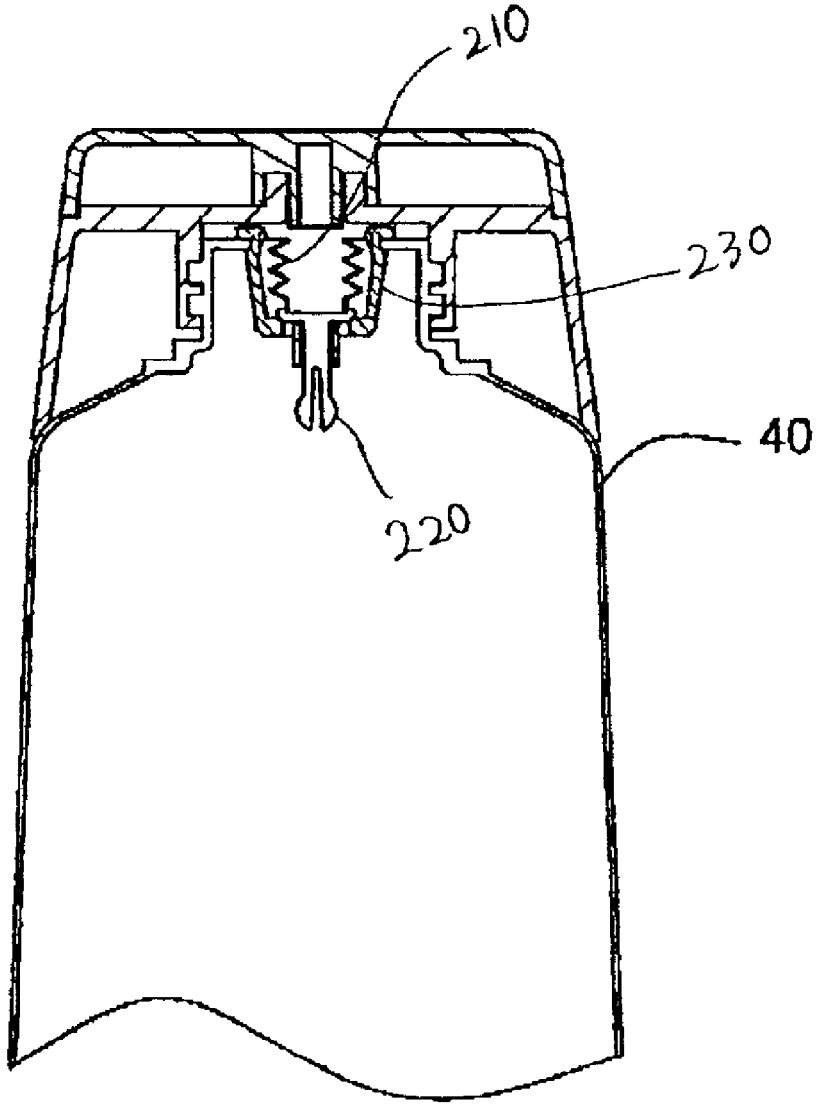
FIG. 32 is an enlarged view showing the tube-type container according to the seventh embodiment of the present invention.
Figure 33:
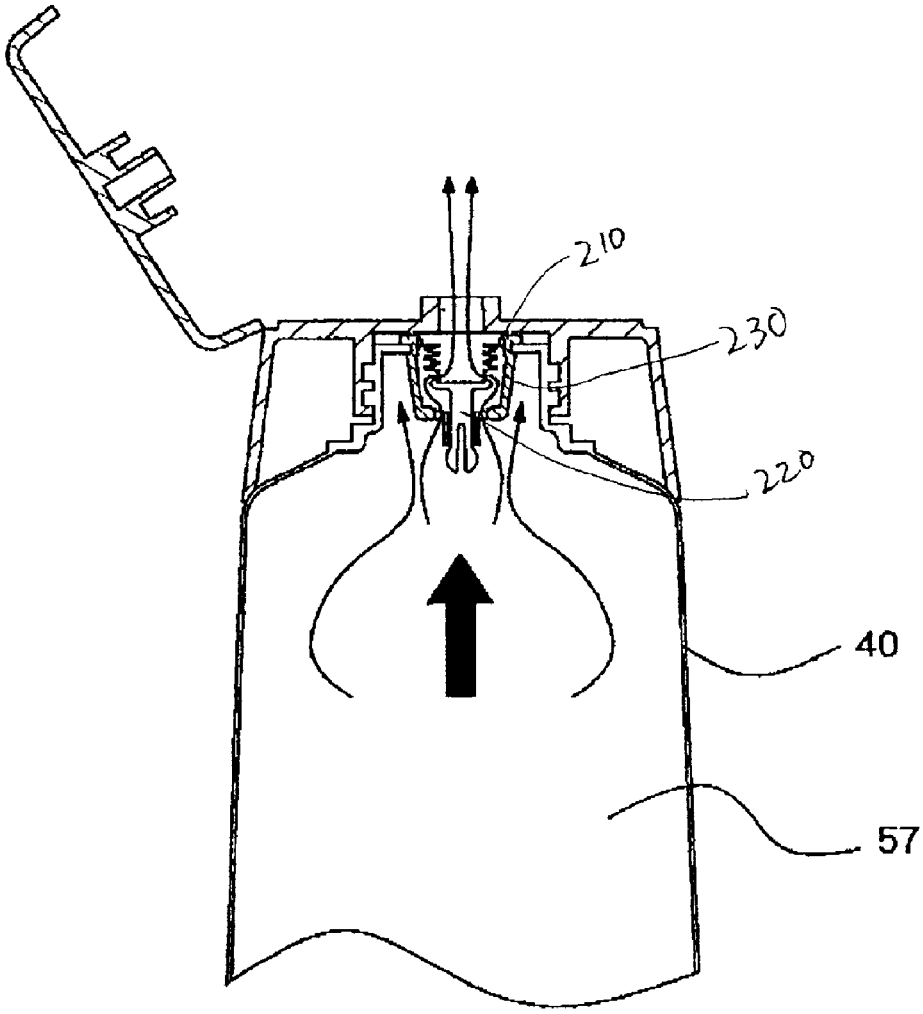
FIG. 33 is a schematic diagram showing the discharging movements of the fluid by the tube-type container according to the seventh embodiment of the present invention.
Figure 34:
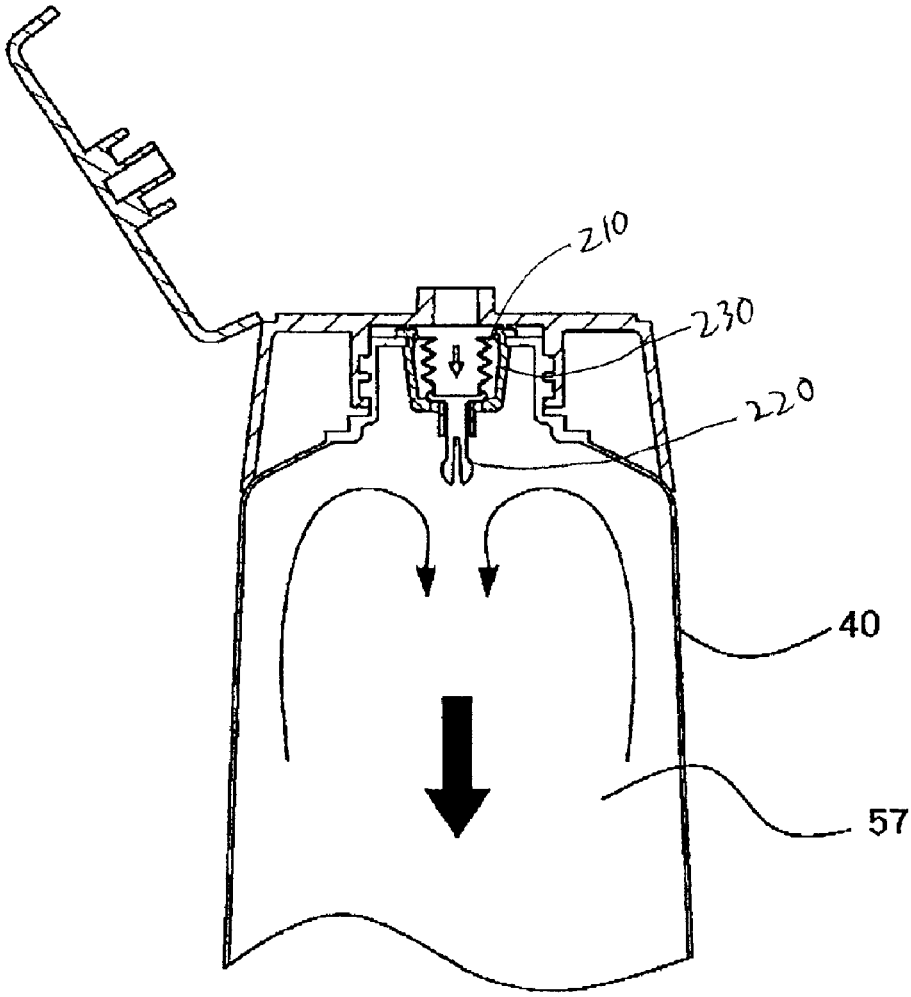
FIG. 34 is a schematic diagram showing the state of finishing discharging the fluid by the tube-type container according to the seventh embodiment of the present invention.
Figure 35:
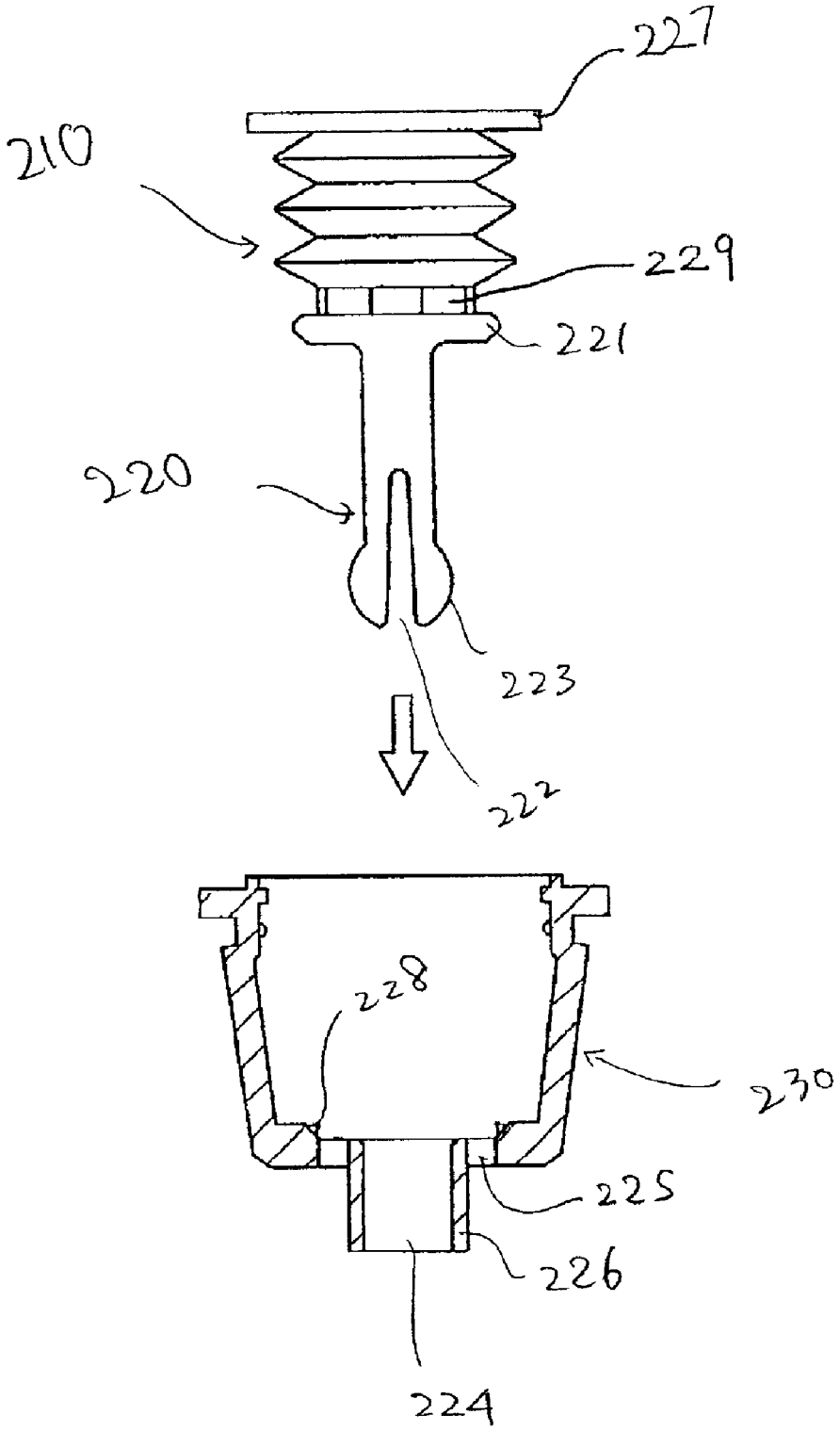
FIG. 35 is a schematic diagram showing an outline of the valve body 210 and the tube-shaped material 230.
Figure 36:
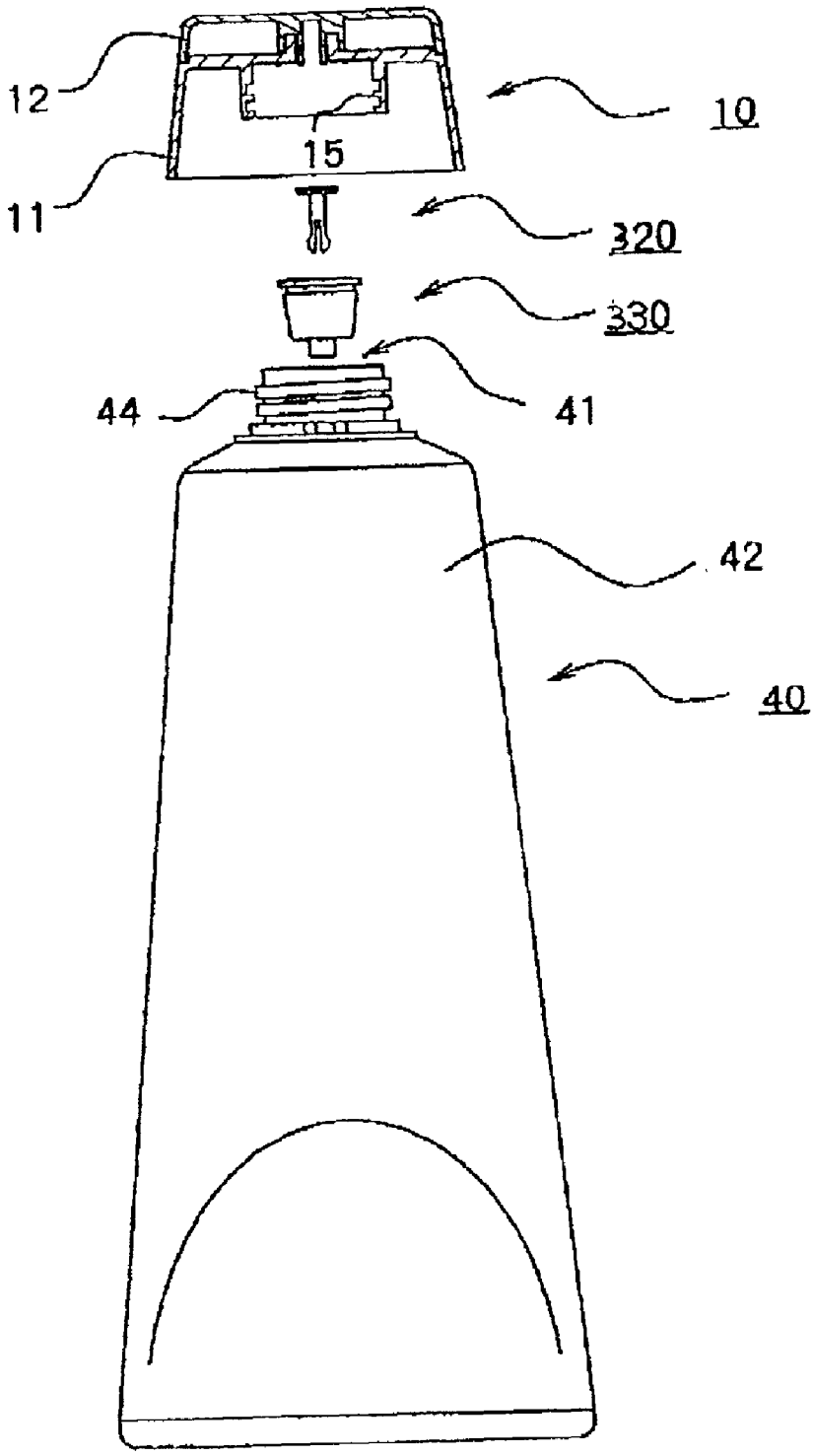
FIG. 36 is an exploded schematic diagram showing the tube-type container according to a eighth embodiment of the present invention.

In an embodiment, as in the $5^{th}$ embodiment, a support can be bellows having two ends, one end being attached to an inner wall of the cylinder-shaped material, the other end being attached to a base of a fitting portion. The fitting portion need not be convex. FIGS. 31–35 show such an embodiment of the present invention (a $7^{th}$ embodiment). In this embodiment, a cylinder-shaped material 230 has a side opening 225 and is configured to be fitted in the mouth portion 41 of the main body 40 (FIG. 32). Bellows 210 and a fitting portion 221 of a valve body 220 are attached (FIGS. 32 and 35). An upper periphery 227 of the bellows 210 is fitted against an inner wall of the cylinder-shaped material 230 at an upper portion of the cylinder-shaped material 230 (FIGS. 32 and 35). The bellows 210 are elastic and allow the fitting portion 221 to move in the axial direction when the fluid passes through the opening 225 upon being squeezed by external force (FIG. 33). The liquid then passes through a gap 229 and is discharged from the mouth. When the external force is released, backflow of the fluid instantaneously occurs due to elasticity-restoring function of the main body wherein the pressure of the fluid inside the main body 40 is lower than the pressure outside the main body 40, whereby the opening is closed by moving the fitting portion 221 downward (FIG. 34). The bellows 210 support the fitting portion 221 elastically and thus when the external force is released, the bellows 210 are restored to the original position, thereby closing the opening 225 with the fitting portion 221 (FIGS. 34 and 35). The valve body 220 has an insertion portion 223 which is inserted through a central opening 224 of the cylinder-shaped material 230, which opening is defined by a ring or cylinder 226 (FIG. 35). The insertion portion 223 has a tip end having an expanded portion with a recess 222, so that when external force is exerted and the valve portion 220 is pushed upward, the expanded portion (bump with the recess) prevents the valve body from being disengaged from the ring 226. Thus, in this embodiment, the bellows 210 and the bump with the recess 222 function as a support. In order to secure airtight contact between the fitting portion 221 and the side opening 225, the cylinder-shaped material 230 may have a small annular projection 228 formed along the side opening 225 (FIG. 35) so that the fitting portion 221 can be fitted against the annular projection 228. The bellows 210 maybe made of resilient resin.

Figure 37:
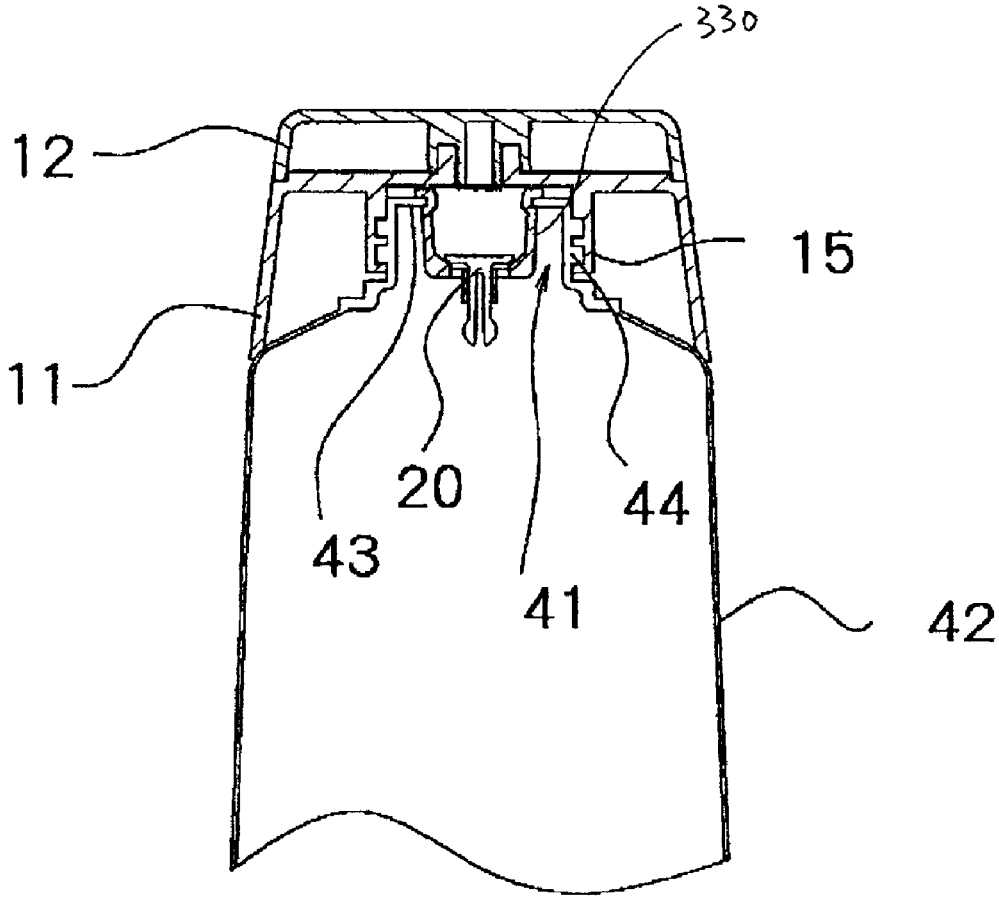
FIG. 37 is an enlarged view showing the tube-type container according to the eighth embodiment of the present invention.
Figure 38:
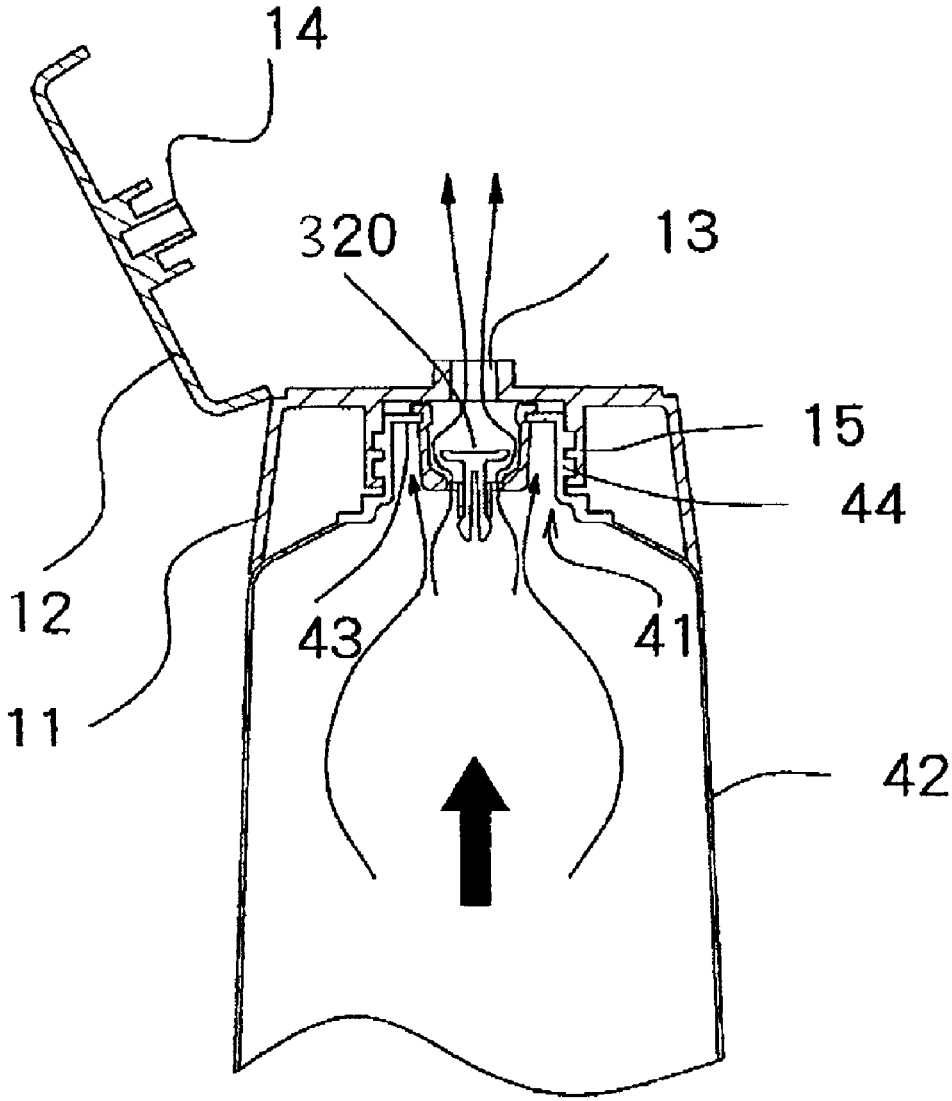
FIG. 38 is a schematic diagram showing the discharging movements of the fluid by the tube-type container according to the eighth embodiment of the present invention.
Figure 39:
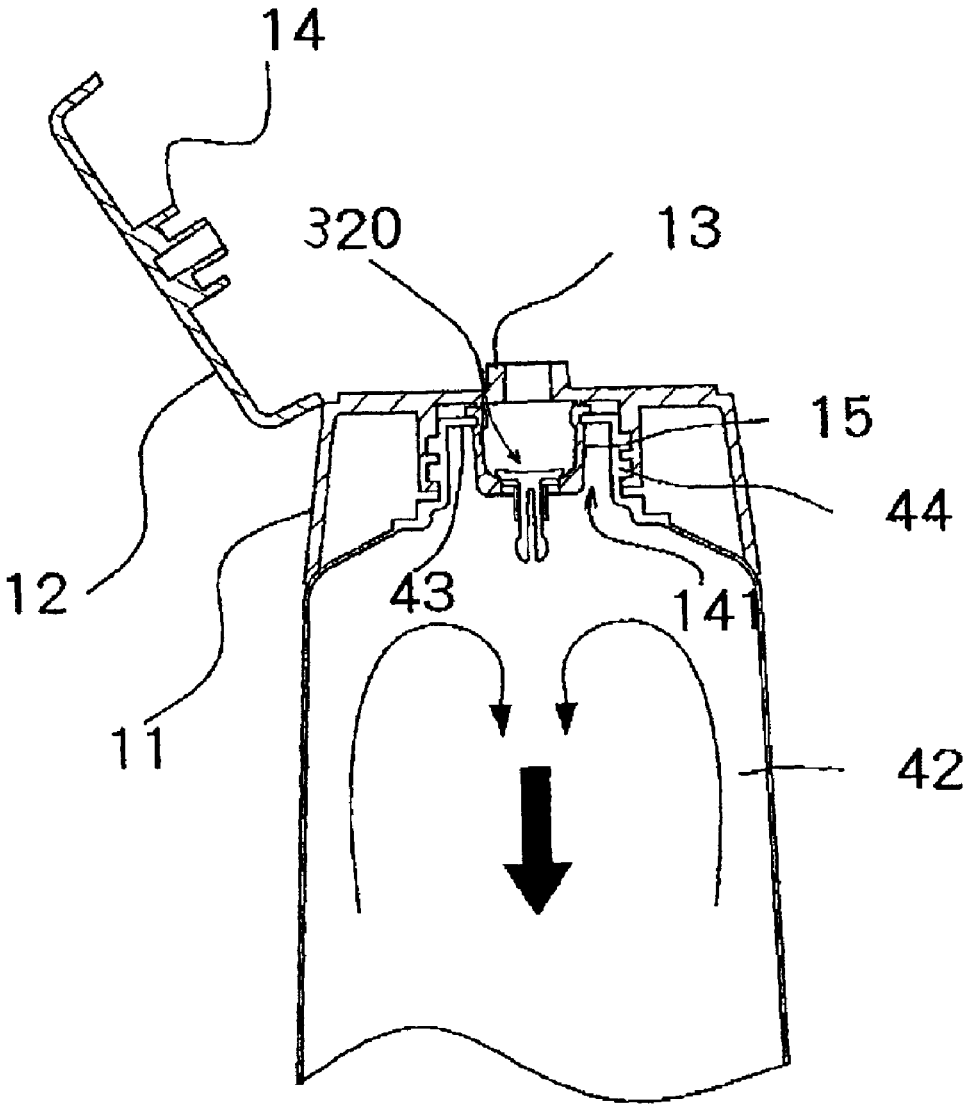
FIG. 39 is a schematic diagram showing the state of finishing discharging the fluid by the tube-type container according to the eighth embodiment of the present invention.
Figure 40A:
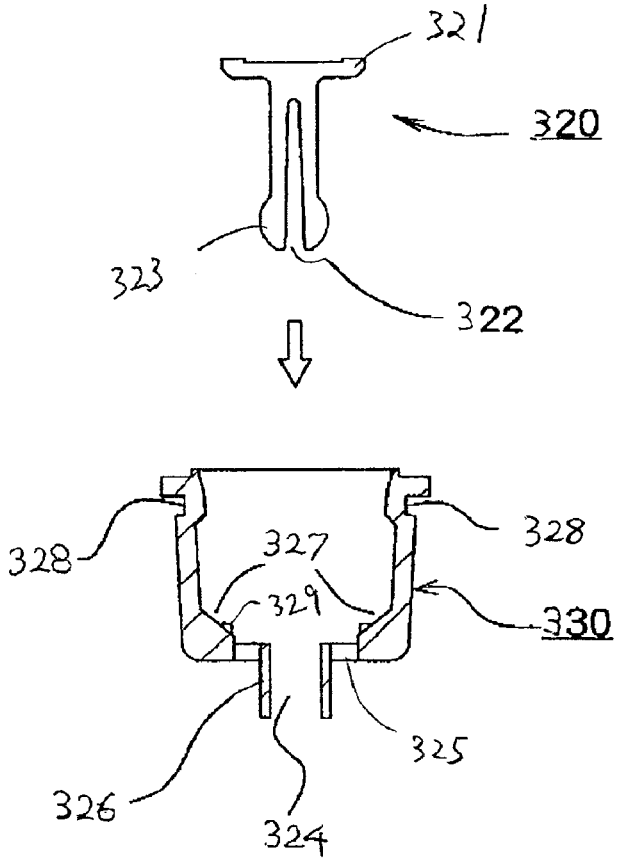
FIG. 40(*a*) is a cross sectional view showing an outline of the valve body 320 and the tube-shaped material 330, and FIG. 40(*b*) is a bottom view of the valve body.
Figure 40B:
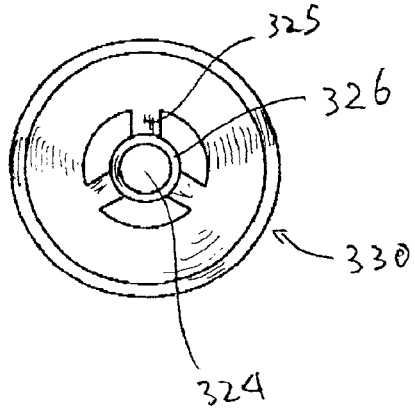

In another embodiment, as in the $7^{th}$ embodiment, the valve body can be composed of a fitting portion and an insertion portion having an expanded tip end with a recess. In that case, upward movement of the valve body is limited by the expanded tip end, and downward movement of the valve body is limited by the fitting portion. Thus, unlike the $7^{th}$ embodiment, no bellows may not be required, although the use of bellows may stabilize the movement of the valve body and enhance closing operation by constantly exerting downward force on the valve body against an opening of a cylinder-shaped material. FIGS. 36–40(*b*) show such an embodiment of the present invention (a $8^{th}$ embodiment). In this embodiment, a cylinder-shaped material 330 has a side opening 325 and is configured to be fitted in the mouth portion 41 of the main body 40 (FIG. 37). The valve body 320 has an insertion portion 323 which is inserted through a central opening 324 of the cylinder-shaped material 330, which opening is defined by a ring or cylinder 326 (FIGS. 40(*a*) and 40(*b*)). The insertion portion 323 has a tip end having an expanded portion with a recess 322, so that when external force is exerted and the valve portion 320 is pushed upward, the expanded portion (bump with the recess) prevents the valve body 320 from being disengaged from the ring 326 Thus, in this embodiment, the bump with the recess 322 functions as a support. When the external force is released, backflow of the fluid instantaneously occurs due to elasticity-restoring function of the main body wherein the pressure of the fluid inside the main body 40 is lower than the pressure outside the main body 40, whereby the opening is closed by moving a fitting portion 321 downward (FIG. 39). When the external force is released, the side opening 325 is closed with the fitting portion 321 (FIGS. 39 and 40). In order to secure airtight contact between the fitting portion 321 and the side opening 325, the cylinder-shaped material 330 may have a small annular projection 329 formed along the side opening 325 (FIG. 40(*a*)) so that the fitting portion 321 can be fitted against the annular projection 329. Further, a tapered surface 327 can be formed to further secure the seal when the opening is closed. The cylinder-shaped material 330 is fitted in the mouth portion of the tube by using a press-fitting recess 328 (FIG. 40(*a*)).

FIGS. 41(*a*) and 41(*b*) show a variation of the $2^{nd}$ embodiment (embodiment 2(1)). As shown in these figures, the support can be a perforated funnel-shaped support 453 connected to a base of a fitting portion 452, said support being elastic and having a periphery 456 attached to an inner wall of a cylinder-shaped material 450. In this embodiment, the cylinder-shaped material 450 has an opening 454 and is configured to be fitted in the mouth portion 41 of the main body 40. The perforated support 453 and the fitting portion 452 are integrated to form a valve portion 451. As with the $_2$nd embodiment, the valve portion 451 is a single piece formed by molding, for example. The periphery 456 of the support 453 is fitted against an inner wall of the cylinder-shaped material at a top portion of the cylinder-shaped material. The support 453 is elastic and allows the fitting portion 452 to move in the axial direction when the fluid passes through the opening 454 upon being squeezed by external force. When the external force is released, backflow of the fluid instantaneously occurs due to elasticity-restoring function of the main body wherein the pressure of the fluid inside the main body is lower than the pressure outside the main body, whereby the opening 454 is closed by moving the fitting portion 452 downward (FIG. 41(*b*)). The support 453 supports the fitting portion 452 elastically and thus when the external force is released, the support 453 is restored to the original position, thereby closing the opening 454 with the fitting portion 452 (FIG. 41(*b*)). In order to secure airtight contact between the fitting portion 452 and the opening 454, a tapered annular surface 455 can be formed along the edge of the opening 454, which surface and a tapered counter surface 457 formed in the fitting portion 452 are in air-tight contact when the external force is released. The support 453 may be made of resilient resin.

FIGS. 42(*a*) and 42(*b*) show another variation of the $2^{nd}$ embodiment (embodiment 2(2)). As shown in these figures, the support can be a perforated funnel-shaped support 553 connected to a base of a fitting portion 552, said support being elastic and having a periphery 556 attached to an inner wall of a cylinder-shaped material 550. In this embodiment, the cylinder-shaped material 550 has an opening 554 and is configured to be fitted in the mouth portion 41 of the main body 40. The perforated support 553 and the fitting portion 552 are integrated to form a valve portion 551. As with the $_2$nd embodiment, the valve portion 551 is a single piece formed by molding, for example. The periphery 556 of the support 553 is fitted against an inner wall of the cylinder-shaped material at a top portion of the cylinder-shaped material. The support 553 is elastic and allows the fitting portion 552 to move in the axial direction when the fluid passes through the opening 554 upon being squeezed by external force. When the external force is released, backflow of the fluid instantaneously occurs due to elasticity-restoring function of the main body wherein the pressure of the fluid inside the main body is lower than the pressure outside the main body, whereby the opening 554 is closed by moving the fitting portion 552 downward (FIG. 42(*b*)). The fitting portion 552 has an annular fin 557 so that sealing can be secured. The support 553 supports the fitting portion 552 elastically and thus when the external force is released, the support 553 is restored to the original position, thereby closing the opening 554 with the fitting portion 452 (FIG. 42(*b*)). The support 553 may be made of resilient resin.

FIGS. 43(*a*) and 43(*b*) show another variation of the $2^{nd}$ embodiment (embodiment 2(3)). As shown in these figures, the support can be a perforated funnel-shaped support 653 connected to a base of a fitting portion 652, said support being elastic and having a periphery 656 attached to an inner wall of a cylinder-shaped material 650. In this embodiment, the cylinder-shaped material 650 has an opening 654 and is configured to be fitted in the mouth portion 41 of the main body 40. The perforated support 653 and the fitting portion 652 are integrated to form a valve portion 651. As with the $2^{nd}$ embodiment, the valve portion 651 is a single piece formed by molding, for example. The periphery 656 of the support 653 is fitted against an inner wall of the cylinder-shaped material at a top portion of the cylinder-shaped material. The support 653 is elastic and allows the fitting portion 652 to move in the axial direction when the fluid passes through the opening 654 upon being squeezed by external force. When the external force is released, backflow of the fluid instantaneously occurs due to elasticity-restoring function of the main body wherein the pressure of the fluid inside the main body is lower than the pressure outside the main body, whereby the opening 654 is closed by moving the fitting portion 652 downward (FIG. 43(*b*)). The support 653 supports the fitting portion 652 elastically and thus when the external force is released, the support 653 is restored to the original position, thereby closing the opening 654 with the fitting portion 652 (FIG. 43(*b*)). In order to secure airtight contact between the fitting portion 652 and the opening 654, a tapered annular surface 655 can be formed along the edge of the opening 654, which surface and a tapered counter surface 657 formed in the fitting portion 652 are in air-tight contact when the external force is released. The support 653 may be made of resilient resin.

Figure 44A:
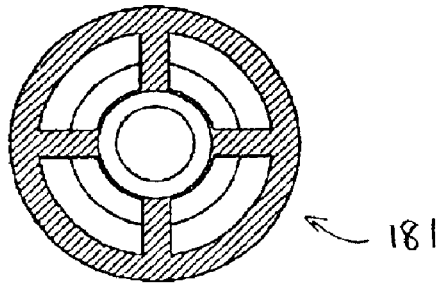
FIG. 44(*a*) is a top view of the valve portion 181, and FIG. 44(*b*) is a cross sectional view showing an outline of the valve portion 181 and the tube-shaped material 180.
Figure 44B:
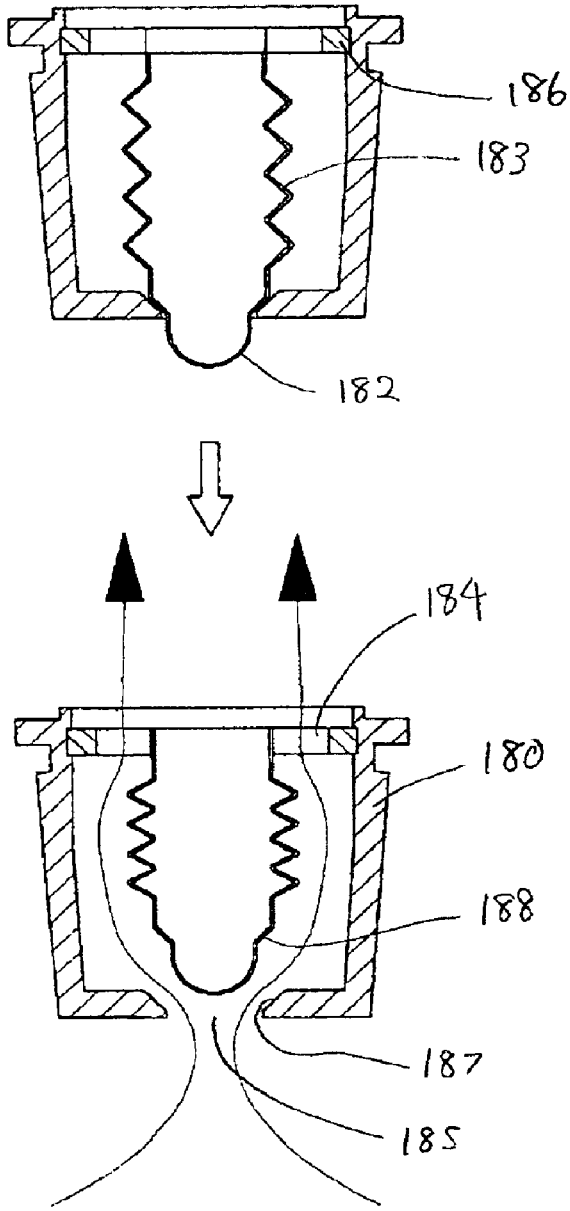

FIGS. 44(*a*) and 44(*b*) show another embodiment (a $9^{th}$ embodiment). FIG. 44(*a*) is a top view of a valve portion 181, and FIG. 44(*b*) shows how the valve portion works. This embodiment is similar to the $5^{th}$ embodiment with regard to the use of bellows (blow molding), but different therefrom with regard to the location of a support opening and the integrality of a fitting portion and a support. That is, in this embodiment, a fitting portion 182 is integrated with bellows 183 so that the fitting portion 182 and the bellows 183 can be formed together by blow molding. The bellows 183 are connected to a ring support 186 having a support opening 184. The ring support 186 is attached to an inner wall of a cylinder-shaped material 180. The bellows 183 are elastic and can provide an elasticity-restoring function. In this embodiment, the cylinder-shaped material 180 has an opening 185 and is configured to be fitted in the mouth portion 41 of the main body 40. The bellows 183 allows the fitting portion 182 (convex portion) to move in the axial direction when the fluid passes through the opening 185 upon being squeezed by external force. The liquid then passes through the support opening 184 and is discharged from the mouth. When the external force is released, backflow of the fluid instantaneously occurs due to elasticity-restoring function of the main body wherein the pressure of the fluid inside the main body is lower than the pressure outside the main body, whereby the opening 185 is closed by moving the fitting portion 182 downward (FIG. 44(*b*)). The bellows 183 supports the fitting portion 182 elastically and thus when the external force is released, the bellows 183 is restored to the original position, thereby closing the opening 185 with the fitting portion 182 (FIG. 44(*b*)). In order to secure airtight contact between the fitting portion 182 and the opening 185, a tapered annular surface 187 can be formed along the edge of the opening 185, which surface and a tapered counter surface 188 formed in the fitting portion 182 are in airtight contact when the external force is released.

In the above embodiments, all of the $1^{st}$ through $9^{th}$ embodiments comprise: (i) a tube-type container main body being squeezable and having an elasticity-restoring function; (ii) a cylinder-shaped material fitted in the mouth portion, said cylinder-shaped material having at a bottom an opening through which the fluid passes; (iii) a valve body comprising a fitting portion configured to be liquid-tightly fitted in the opening, said valve body being movable in said cylinder-shaped material in its axial direction; and (iv) a support for limiting movement of the valve body away from the opening.

In the $1^{st}$ and the $8^{th}$ embodiments, there is no counterforce or reaction force to push the valve body down when external force is released. In these embodiments, the valve body is not fixedly attached to anything. The valve body and a support are integrated to form a single piece. The support is attached to a bottom of the valve body and prevents the valve body from being disengaged from a cylinder-shaped material.

In the $2^{nd}$ through the $7^{th}$ embodiments, counterforce or reaction force is exerted on the valve body to push the valve body back to the original position when external force is released.

In the $2^{nd}$, the $3^{rd}$, the $4^{th}$, and the $6^{th}$ embodiments (optionally in the $7^{th}$ embodiment), counterforce is not constantly exerted on the valve body. Only when external force is applied and pushes the valve body upward (i.e., in the direction to discharge the liquid), counterforce is exerted elastically on the valve body. In the $5^{th}$ and the $9^{th}$ embodiments, bellows are used as an upper support, but there is no lower support. Thus, in the $5^{th}$ and $9^{th}$ embodiments, downward force needs to be constant to avoid disarrangement of the valve body from the opening. However, it is not necessary (although it is an option) to constantly exert downward force on the valve body to forcefully close the opening, because the tube-type main body has an elasticity-restoring function, and thus, after the liquid is discharged from the main body through the mouth, the pressure of the liquid stored in the main body is constantly lower than the pressure of the liquid filling the cylinder-shaped material. Thus, by using the elasticity-restoring function, the structure of the valve body can be simplified.

In the $1^{st}$, the $2^{nd}$, and the $8^{th}$ embodiments, the valve body and the support are a single piece formed by, e.g., molding.

In the $1^{st}$ through the $5^{th}$ and the $9^{th}$ embodiments, the valve body has a convex portion as a fitting portion to close the opening.

In the $2^{nd}$, the $3^{rd}$, the $5^{th}$, and the $9^{th}$ embodiments, there is no lower support.

In the $6^{th}$, the $7^{th}$, and the $8^{th}$ embodiments, the opening through which the liquid passes is not formed in the center, but around the center. That is, a central opening is used to support the valve body.

In the $2^{nd}$, the $3^{rd}$, the $5^{th}$, the $7^{th}$, and $9^{th}$ embodiments, the support comprises (i) a periphery connected to an inner wall of the cylinder-shaped material, (ii) an elastic portion, and (iii) a lower end connected to the fitting portion. Thus, in order to pass the liquid through the support after passing through the opening of the cylinder-shaped material, there must be a gap or opening (a) in the elastic portion itself (the perforated support: the $2^{nd}$ and the $3^{rd}$ embodiments), (b) between the periphery and the elastic portion (the $9^{th}$ embodiment), or (c) between the elastic portion and the fitting portion (the $5^{th}$ and the $7^{th}$ embodiments).

In the $6^{th}$ embodiment, a lower portion of the valve body does not move but is fixed by a lower support to the cylinder-shaped material. Only an upper portion of the valve body moves.

In the above, any combination of elements or parts depicted in different embodiments may be realized to accomplish the general objective of the present invention.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A backflow preventive tube container comprising:

a tube container main body for storing a fluid therein, said main body having a mouth portion for discharging the fluid, said main body being squeezable and having an elasticity-restoring function;

a cylinder-shaped material fitted in the mouth portion, said cylinder-shaped material having at a bottom an opening through which the fluid passes;

a valve body comprising a fitting portion configured to be liquid-tightly fitted in the opening, said valve body being movable in said cylinder-shaped material along its axis; and a support for limiting movement of the valve body away from the opening, wherein the cylinder-shaped material, the valve body, and the support are co-axially arranged, wherein the support (I) comprises bellows fixed to the cylinder-shaped material and attached to a top of the valve body inside the cylinder-shaped material, and/or (II) extends from a bottom of the valve body to the outside of the cylinder-shaped material and moves including its lower end in a direction in which the valve body moves, wherein when the main body is pressed by external force, the fluid pushes the valve body and is discharged through the opening, and when the external force is released, the pressure inside the main body becomes lower than the pressure outside the main body due to elasticity of the main body, thereby retracting the fluid at the opening and closing the valve body, said container further comprising a lid portion comprising a lid body and a lid base, wherein the lid base is attached to the mouth portion of the main body and fixes the cylinder-shaped material interposed between the lid base and the mouth portion, said lid base having a throughhole through which the fluid is discharged, said lid body closing the throughhole by press fitting to the lid base.

2. The container according to claim 1, wherein the valve body and the support are integrally formed as a single piece.

3. The container according to claim 1, wherein the fitting portion is convex.

4. The container according to claim 1, wherein the cylinder-shaped material has a central opening where the valve body is provided, and the opening through which the liquid passes is formed around the central opening separately therefrom.

5. The container according to claim 1, wherein the cylinder-shaped material has a first tapered portion at the bottom, and the fitting portion has a second tapered portion, said first and second tapered portions configured to be fitted together liquid-tightly.

6. The container according to claim 1, wherein the support comprises an end portion provided at a tip the fitting portion having a diameter larger than the opening's diameter.

7. The container according to claim 6, wherein the end portion has a recess in the axial direction of the valve body.

8. The container according to claim 1, wherein the mouth portion and the lid base have screw threads for fitting together, wherein the cylinder-shaped material is fixed therebetween.

9. The container according to claim 1, wherein the fluid to be stored is a viscous liquid.

10. A backflow preventive tube container comprising:

a tube container main body for storing a fluid therein, said main body having a mouth portion for discharging the fluid, said main body being squeezable and having an elasticity-restoring function;

a cylinder-shaped material fitted in the mouth portion, said cylinder-shaped material having at a bottom an opening through which the fluid passes;

a valve body configured to be liquid-tightly fitted in the opening, said valve body being movable in said cylinder-shaped material along its axis; and a support for limiting movement of the valve body away from the opening, wherein the cylinder-shaped material, the valve body, and the support are co-axially arranged, said support extending from a bottom of the valve body to the outside of the cylinder-shaped material and moves including its lower end in a direction in which the valve body moves, said support further comprising a portion which urges the valve body in a direction of closing the openings, wherein when the main body is pressed by external force, the fluid pushes the valve body and is discharged through the opening, and when the external force is released, the pressure inside the main body becomes lower than the pressure outside the main body due to elasticity of the main body, thereby retracting the fluid at the opening and closing the valve body, wherein the portion for urging the valve body is bellows fixed to the cylinder-shaped material and attached to a top of the valve body inside the cylinder-shaped material.

11. The container according to claim 10, wherein the cylinder-shaped material has a central opening where the valve body is provided, and the opening through which the liquid passes is formed around the central opening separately therefrom.

12. The container according to claim 10, wherein the fluid to be stored is a viscous liquid.

13. The container according to claim 10, wherein the support comprises an end portion provided at a tip of the fitting portion, said end portion having a diameter larger than the opening's diameter.

14. The container according to claim 13, wherein the end portion has a recess in the axial direction of the valve body.

* * * * *